US011142002B2

(12) United States Patent
Nakayama

(10) Patent No.: US 11,142,002 B2
(45) Date of Patent: Oct. 12, 2021

(54) LIFTING MECHANISM AND RECORDING APPARATUS

(71) Applicant: SEIKO EPSON CORPORATION, Tokyo (JP)

(72) Inventor: Hiroyuki Nakayama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 266 days.

(21) Appl. No.: 16/526,745

(22) Filed: Jul. 30, 2019

(65) Prior Publication Data

US 2020/0039256 A1 Feb. 6, 2020

(30) Foreign Application Priority Data

Jul. 31, 2018 (JP) ..... JP2018-143263

(51) Int. Cl.
*B41J 15/04* (2006.01)

(52) U.S. Cl.
CPC ..... *B41J 15/042* (2013.01)

(58) Field of Classification Search
CPC .. B65H 2301/4135; B65H 2301/41346; B65H 2402/52; B65H 2801/15; B65H 2402/32; B65H 19/126; B65H 16/06; B65H 2701/1133; B65H 2801/03; B41J 15/042
See application file for complete search history.

(56) References Cited

U.S. PATENT DOCUMENTS 8,851,412 B2 * 10/2014 Tenpaku ..... B41J 15/042 242/533
8,919,686 B2 * 12/2014 Tenpaku ..... B65H 19/126 242/533
10,118,415 B2 * 11/2018 Culubret ..... B41F 13/03
2012/0091250 A1 * 4/2012 Tenpaku ..... B65H 19/126 242/596
2012/0187233 A1 7/2012 Tenpaku et al.
(Continued)

FOREIGN PATENT DOCUMENTS

| | | |
|---|---|---|
| JP | 2012-153456 | 8/2012 |
| JP | 2014144558 | 8/2014 |
| WO | 2016018275 | 2/2016 |

OTHER PUBLICATIONS

European Search Report issued in corresponding application No. EP19189320 dated Dec. 3, 2019.

*Primary Examiner* — William A. Rivera
(74) *Attorney, Agent, or Firm* — Workman Nydegger

(57) ABSTRACT

A recording apparatus comprises a lifting mechanism lifting and lowering a roll-shaped medium, wherein the lifting mechanism includes a lifting unit which lifts and lowers in an apparatus height direction and on which the roll-shaped medium is placed, a position adjustment unit configured to adjust a position of the lifting unit in the apparatus height direction, and a base unit supporting the lifting unit and the position adjustment unit. The base unit includes an insertion portion through which a shaft member supporting the base unit is inserted. The insertion portion includes an inner circumferential portion facing an outer circumferential portion of the shaft member. A plurality of rolling elements is disposed in the inner circumferential portion of the insertion portion, and the plurality of rolling elements protrudes from the inner circumferential portion when viewed from an axial direction in which the shaft member extends.

10 Claims, 15 Drawing Sheets

(56) References Cited

U.S. PATENT DOCUMENTS

| | | | | |
|---|---|---|---|---|
| 2012/0199687 | A1* | 8/2012 | Kobayashi | B41J 15/046 242/566 |
| 2015/0091997 | A1* | 4/2015 | Ito | B65H 16/06 347/104 |
| 2017/0165983 | A1* | 6/2017 | Takahashi | B65H 19/126 |
| 2017/0225492 | A1* | 8/2017 | Culubret | B65H 23/188 |
| 2020/0039256 | A1* | 2/2020 | Nakayama | B41J 15/042 |
| 2020/0238738 | A1* | 7/2020 | Sakai | B41J 15/048 |

* cited by examiner

LIFTING MECHANISM AND RECORDING APPARATUS

The present application is based on, and claims priority from JP Application Serial Number 2018-143263, filed Jul. 31, 2018, the disclosure of which is hereby incorporated by reference herein in its entirety.

BACKGROUND

1. Technical Field

The present disclosure relates to a lifting mechanism lifting and lowering a roll-shaped medium and a recording apparatus including a lifting mechanism.

2. Related Art

A recording apparatus recording an image and a character while pulling out a medium from a roll paper sheet is known in the related art. In such a recording apparatus, a paper tube of a roll paper sheet is rotatably attached to and detached from a pair of flanges on delivery unit sides. At this time, the paper tube of the roll paper sheet is lifted and lowered in accordance with a height of the flanges by using a mechanism (lifting mechanism) lifting and lowering the roll paper sheet.

JP-A-2012-153456 discloses a roll medium lifting device. Specifically, the roll medium lifting device includes an operation lever, a cam unit, a lifting unit, and a base unit, and two rods are inserted through the base unit. In this way, it is possible to move the roll medium placed on the roll medium lifting device in a width direction by moving the roll medium lifting device in the width direction in which the rods extend. In such a configuration, for example, the roll medium to be used is easily disposed on the flanges.

In the roll medium lifting device disclosed in JP-A-2012-153456, there is a problem that, as a weight of the roll medium placed on the lifting unit increases, a frictional force between the base unit and the pair of rods increases and that it becomes difficult to move the roll medium in the width direction. In such a case, a pair of flanges are moved to the two edge portions of the roll medium respectively so that the roll medium is installed to the flanges. However, as the pair of flanges are moved to the two edge portions of the roll medium, a reference position (medium edge position) of the roll paper sheet deviates in the width direction. Further, in this case, a user has to adjust positions of the flanges again, which causes a burden on the user.

SUMMARY

A recording apparatus according to an aspect of the present application includes a lifting mechanism lifting and lowering a roll-shaped medium, in which the lifting mechanism includes a lifting unit which lifts and lowers in an apparatus height direction and on which the roll-shaped medium is placed, a position adjustment unit configured to adjust a position of the lifting unit in the apparatus height direction, and a base unit supporting the lifting unit and the position adjustment unit, the base unit includes an insertion portion through which a shaft member supporting the base unit is inserted, the insertion portion includes an inner circumferential portion facing an outer circumferential portion of the shaft member, a plurality of rolling elements is disposed in the inner circumferential portion of the insertion portion, and the plurality of rolling elements protrudes from the inner circumferential portion of the insertion portion when viewed in a axial direction in which the shaft member extends.

In the recording apparatus described above, when a straight line is defined as a line which is orthogonal to the axial direction and the apparatus height direction, and when the straight line passes through a center of the shaft member, at least three rolling elements of the plurality of rolling elements may be disposed in the inner circumferential portion of the insertion portion above the straight line in the apparatus height direction and in the inner circumferential portion of the insertion portion below the straight line in the apparatus height direction.

In the recording apparatus described above, the plurality of rolling elements may be arranged in parallel substantially in the axial direction.

The recording apparatus described above may further include a guide member disposed at a predetermined distance from the shaft member and the guide member supports the lifting mechanism together with the shaft member, and the base unit may include a guide side insertion portion through which the guide member is inserted, the guide side insertion portion includes an inner circumferential portion facing an outer circumferential portion of the guide member, and a guide side rolling element configured to abut to the guide member from an upper side in the apparatus height direction may be disposed in the inner circumferential portion of the guide side insertion portion.

In the recording apparatus described above, the base unit may include a protrusion portion facing the guide member from a lower side in the apparatus height direction in the inner circumferential portion of the guide side insertion portion.

A lifting mechanism according to another aspect of the present application includes a lifting unit which lifts and lowers in an apparatus height direction and on which a roll-shaped medium is placed; a position adjustment unit configured to adjust a position of the lifting unit in the apparatus height direction; and a base unit supporting the lifting unit and the position adjustment unit, in which the base unit includes an insertion portion through which a shaft member supporting the base unit is inserted, the insertion portion includes an inner circumferential portion facing an outer circumferential portion of the shaft member, a plurality of rolling elements is disposed in the inner circumferential portion of the insertion portion, and the plurality of rolling elements protrudes from the inner circumferential portion of the insertion portion when viewed in an axial direction in which the shaft member extends.

In the lifting mechanism described above, when a straight line is defined as a line which is orthogonal to the axial direction and the apparatus height direction, and when the straight line passes through a center of the shaft member, the plurality of rolling elements may be disposed in the inner circumferential portion of the insertion portion at an upper side of the straight line in the apparatus height direction and in the inner circumferential portion of the insertion portion at a lower side of the straight line in the apparatus height direction, where at least three rolling elements may be disposed in the inner circumferential portion.

In the lifting mechanism described above, the plurality of rolling elements may be arranged in parallel in the axial direction.

The lifting mechanism described above may further include a guide member which is disposed at a predetermined distance from the shaft member and which supports the base unit together with the shaft member, in which the base unit may include a guide side insertion portion through which the guide member is inserted, the guide side insertion includes an inner circumferential portion facing an outer circumferential portion of the guide member, and a guide side rolling element configured to abut to the guide member from an upper side in the apparatus height direction may be disposed in the inner circumferential portion of the guide side insertion portion.

In the lifting mechanism described above, the base unit may include a protrusion portion facing the guide member from a lower side in the apparatus height direction in the inner circumferential portion of the guide side insertion portion.

DESCRIPTION OF EXEMPLARY EMBODIMENTS

Hereinafter, a recording apparatus according to an embodiment of the present disclosure will be described with reference to drawings. A large ink jet type printer 1 (hereinafter, referred to as printer 1) will be presented as an example of the recording apparatus.

In each of the drawings shown below, an XYZ coordinate system will be used. X direction is a scanning axis of a recording head 25 (refer to FIG. 1) and is a width direction (hereinafter, also referred to as width direction X or axial direction) of a medium on which recording is performed. Y direction is a depth direction of the printer 1 (refer to FIG. 1) (hereinafter, also referred to as depth direction Y) and is a lengthwise direction of the medium. Z direction is a gravity direction and a vertical direction and is a height direction of the printer 1 (hereinafter, also referred to as height direction Z or apparatus height direction Z).

Further, an apparatus front side is a +Y direction and an apparatus rear side of is a −Y direction. When the printer 1 is viewed from the front side, the left side of the apparatus is a +X direction and the right side of the apparatus is a −X direction. An apparatus upper side (including an upward direction, an upper portion, an upper surface, and the like) is a +Z direction and an apparatus lower side (including a downward direction, a lower portion, a lower surface, and the like) is a −Z direction.

Figure 1:
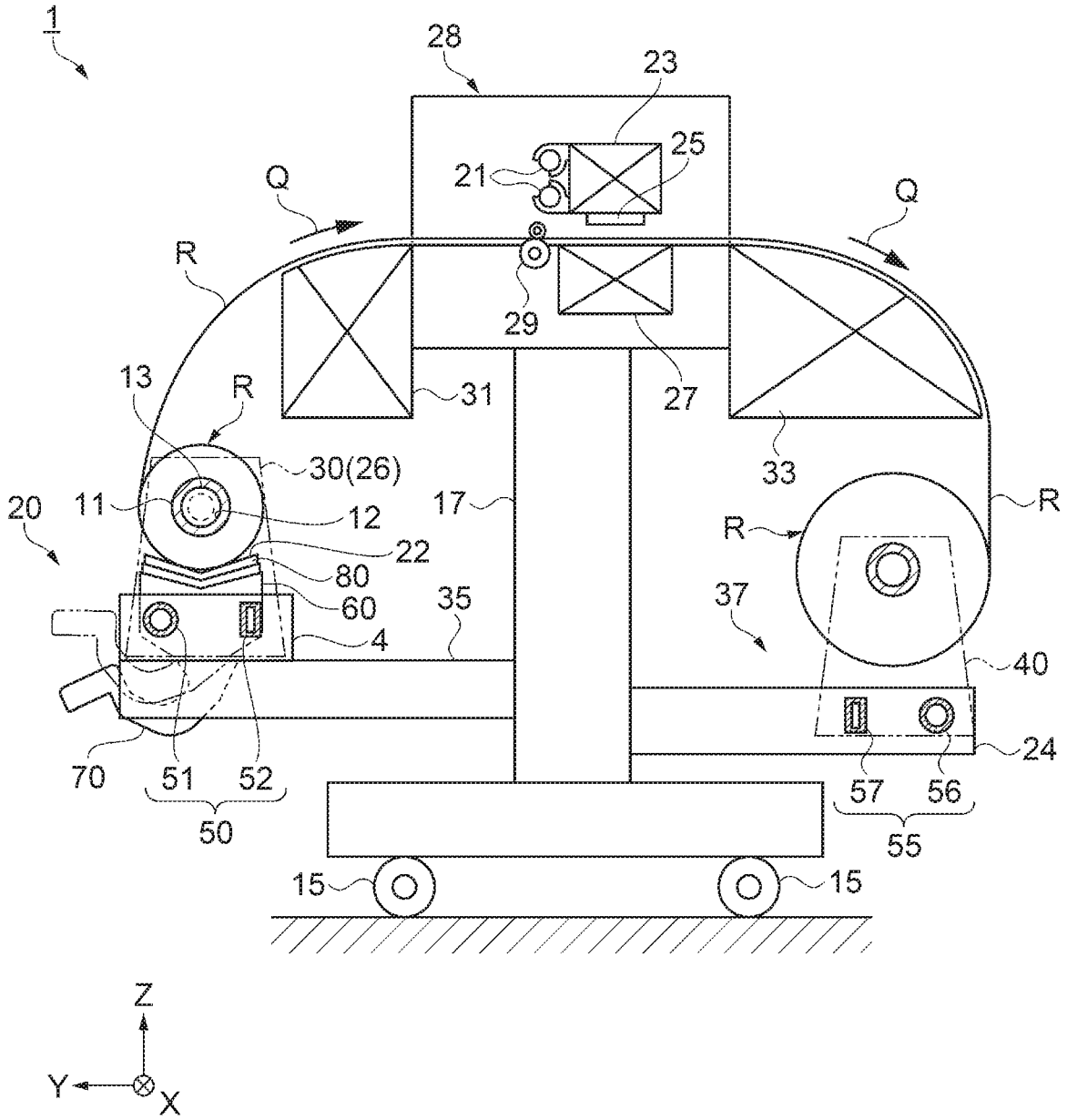
FIG. 1 is a side sectional view showing an outline of an overall configuration of a printer according to a present embodiment.

FIG. 1 is a side sectional view showing an outline of an overall configuration of the printer 1 according to the present embodiment.

Figure 2:
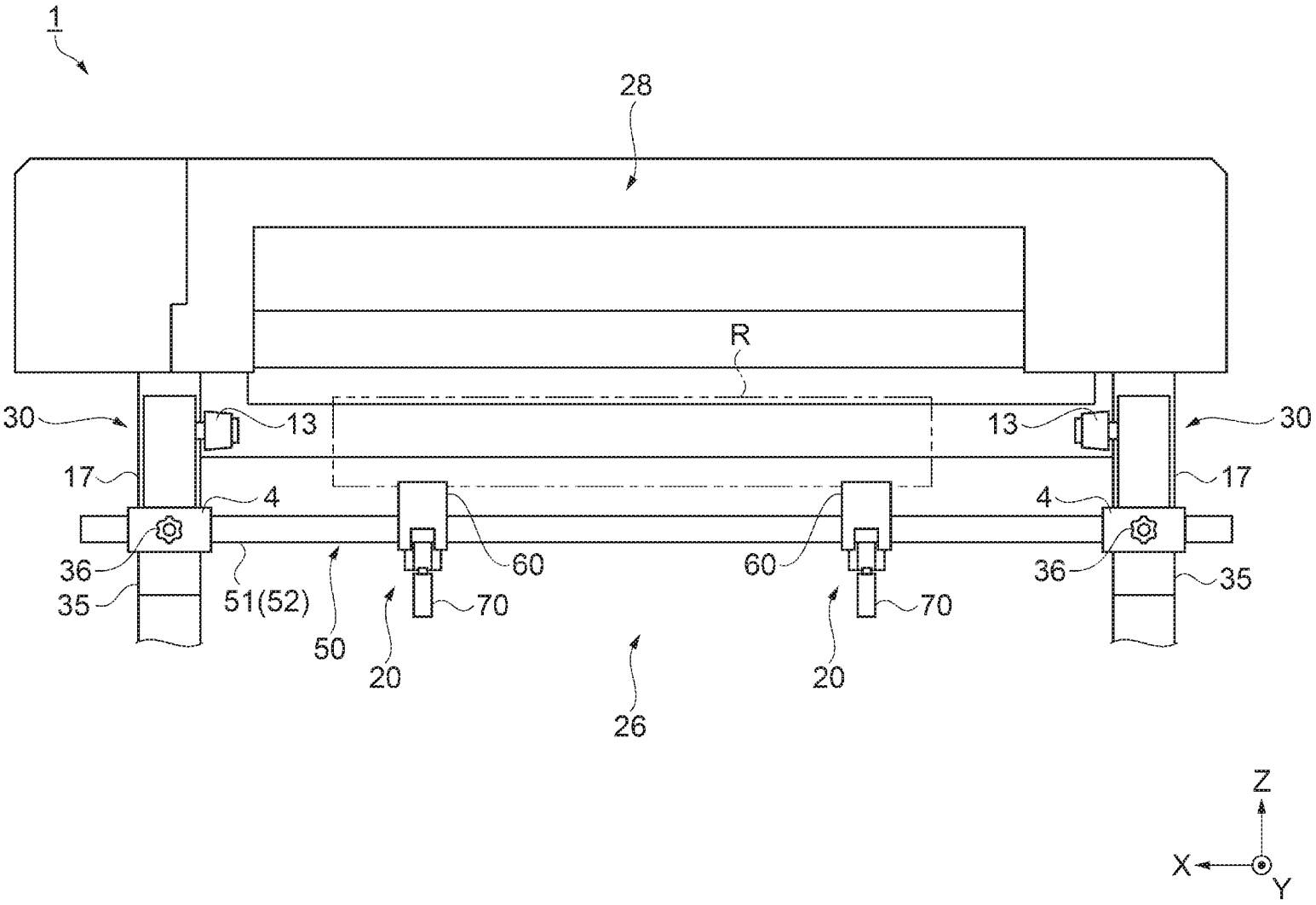
FIG. 2 is a front view showing an outline of the printer.

FIG. 2 is a front view showing an outline of the printer 1. An apparatus lower portion (caster 15 and the like), a medium rolling unit 37, and the like are omitted in FIG. 2.

Figure 3:
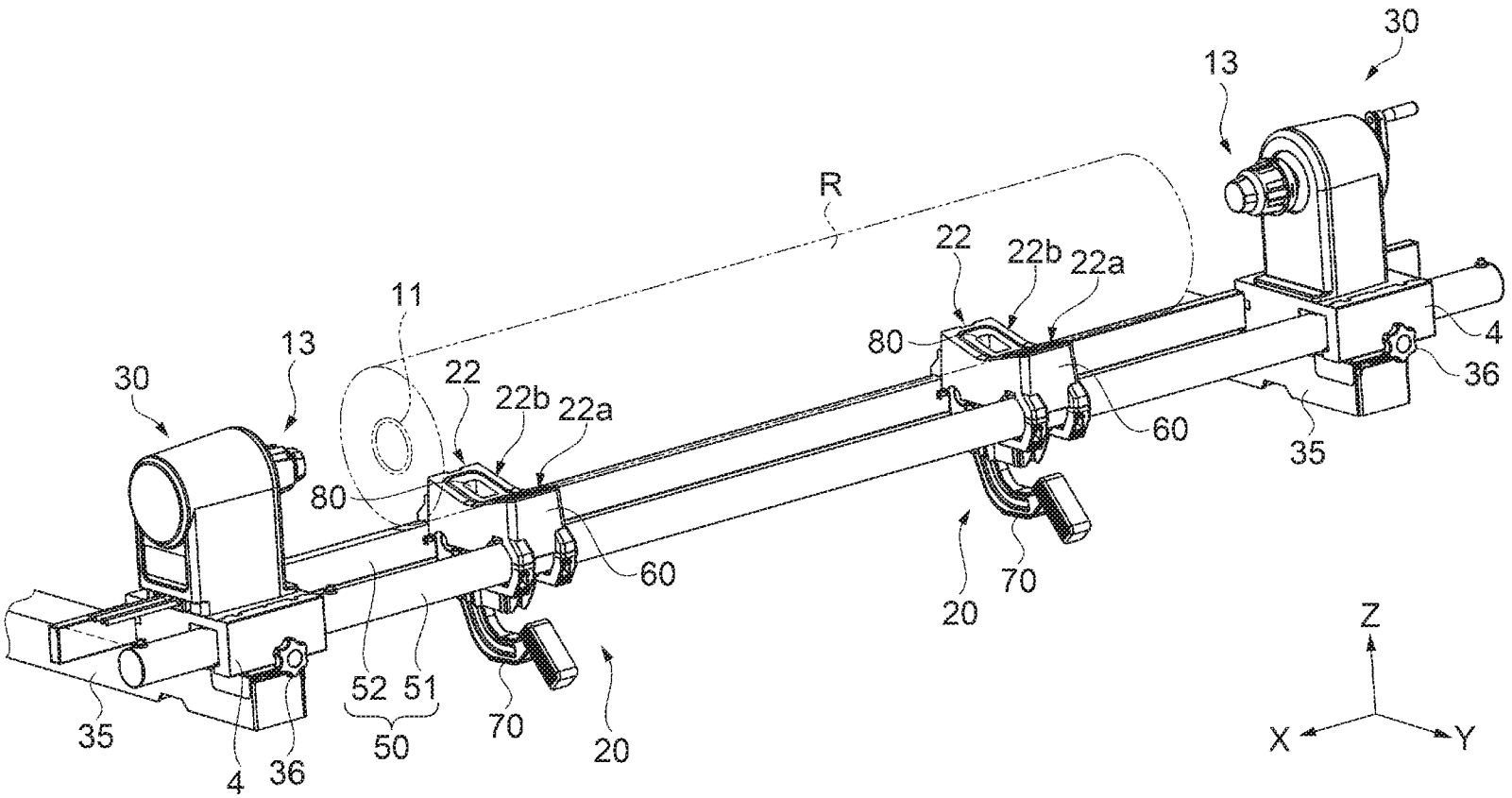
FIG. 3 is a perspective view showing a lifting mechanism, a first holder unit, and a guide unit in a medium delivery unit.

FIG. 3 is a perspective view showing a lifting mechanism 20, a first holder unit 30, and a guide unit 50 in a medium delivery unit 26.

As shown in FIG. 1, the printer 1 includes the medium delivery unit 26, a recording unit 28, and the medium rolling unit 37. The medium delivery unit 26 can unroll a roll medium R as a roll-shaped medium rolled up in a roll shape and feed the roll medium R in a transport direction Q. Specifically, the medium delivery unit 26 includes the first holder unit 30 and a pair of transport rollers 29.

Among these, the first holder unit 30 can pivotably hold both edge portions of the roll medium R. The first holder unit 30 includes a fitting unit 13 which fits into a core opening 12 of a roll core 11 of the roll medium R. The fitting unit 13 may be configured to pivot freely or may be configured to be driven by the power of a motor (not shown). In a freely pivotable configuration, the roll medium R is pulled and unrolled by the pair of transport rollers 29 driving downstream in the transport direction.

Further, when the fitting unit 13 is driven by the power of the motor, the medium delivery unit 26 may be configured not to include the pair of transport rollers 29. A pair of the first holder units 30 are disposed to face each other in the width direction X. Then, at least one of the first holder units 30 can be moved in the width direction X with respect to the guide unit 50 to adjust the mounting position in accordance with the difference in the width size of the roll medium R.

In the present embodiment, with the first holder unit 30 on the left side (+X direction) of the apparatus serving as a reference, the first holder unit 30 on the right side (−X direction) of the apparatus is moved in the width direction X with respect to the guide unit 50 in accordance with the difference in the width size of the roll medium R and the mounting position is adjusted. The reference position (medium edge position) of the roll medium R in the width direction X can be maintained by this adjustment method. Therefore, after the roll medium R is replaced, printing can be performed in the same manner as prior to the replacement without performing printing position adjustment (margin adjustment) or the like.

The lifting mechanism 20 for lifting the roll medium R is disposed between the pair of the first holder units 30. The lifting mechanism 20 includes a base unit 60, an operation lever 70, a lifting unit 80, and a cam unit 9 (refer to FIG. 4). Then, the lifting mechanism 20 (base unit 60) is supported by the guide unit 50. The guide unit 50 includes a first member 51 as shaft member and a second member 52 as a guide member. In the present embodiment, the first member 51 is formed of a rod-shaped (cylindrical) tube member. The second member 52 is formed of a prismatic tube member. Further, the second member 52 is disposed at a predetermined distance from the first member 51. The lifting mechanism 20 is configured to move in the width direction X with respect to the guide unit 50. The predetermined distance at which the second member 52 is disposed from the first member 51 is appropriately determined in consideration of configuration of the operation lever 70 with respect to the base unit 60 and the weight balance between the first member 51 and the second member 52 due to the weight of the placed roll medium R. Then, the second member 52 supports the lifting mechanism 20 (base unit 60) together with the first member 51.

As a user grips the free edge side of the operation lever 70 and operates upward to pivot the operation lever 70 in one direction, the lifting unit 80 can rise to lift the roll medium R. On the other hand, as the operation lever 70 is pivoted in the opposite direction, the lifting unit 80 can lower to lower the roll medium R. The lifting mechanism 20 can lift and lower the heavy roll medium R with a relatively small force by utilizing the magnitude of the lever ratio of the operation lever 70.

In the present embodiment, the operation lever 70 and the cam unit 9 function as a position adjustment unit configured to adjust the position of the lifting unit 80 in the apparatus height direction Z.

A recording unit 28 includes a carriage guide shaft 21 extending in the width direction X, a carriage 23, a recording head 25, and a medium support unit 27. The carriage 23 is movably disposed in the width direction X while being guided by the carriage guide shaft 21. The recording head 25 is disposed at a position to face the medium support unit 27 placed to the carriage 23 and can eject ink onto the roll medium R to record. The medium support unit 27 supports the roll medium R such that the distance between the roll medium R and the recording head 25 can be set to a predetermined distance. The pair of transport rollers 29 are disposed inside the recording unit 28, but may be disposed outside as long as the roll medium R can be fed in the transport direction Q.

A preheater 31 is disposed upstream of the recording unit 28 in the transport direction Q. The preheater 31 warms up the roll medium R in advance at a stage before recording is performed onto the roll medium R, so that the ink landing on the roll medium R is easily dried when recording is performed. An after-heater 33 is disposed downstream of the recording unit 28 in the transport direction Q. The after-heater 33 reliably dries the ink landing on the roll medium R until the roll medium R is rolled by the medium rolling unit 37 after the recording is performed.

The medium rolling unit 37 can roll the roll medium R by the power of a motor (not shown). Specifically, the medium rolling unit 37 includes a second holder unit 40. The second holder unit 40 is movably attached to a third member 56 and a fourth member 57 serving as two tubular members of the guide unit 55. Then, the second holder unit 40 holds the rolled roll medium R.

The printer 1 includes a support frame 17, in a reversed T shape seen from a side, having a caster 15 for moving in a lower edge portion. Further, the support frame 17 is provided in both right and left edge portions of the printer 1 to face each other. The recording unit 28 is disposed in an upper portion of the support frame 17. A sub-frame 35 is disposed in the middle of the support frame 17. Then, the sub-frame 35 holds the edge portions of the first member 51 and the second member 52 included in the guide unit 50. The edge portions of the third member 56 and the fourth member 57 included in the guide unit 55 are held by the sub-frame 24 disposed to the support frame 17. Further, the first member 51 and the second member 52 as the guide unit 50 can also be said to be members constituting the lifting mechanism 20. That is, the first member 51 and the second member 52 can be said to be members included in the printer 1 and can be said to be members included in the lifting mechanism 20.

As shown in FIG. 2, the first holder unit 30 is disposed on the apparatus front side (+Y direction) from the support frame 17 of the printer 1 as a reference. The second holder unit 40 (not shown) is disposed on the rear side (−Y direction) of the apparatus. As described above, the first holder unit 30 is movably disposed with respect to the first member 51 and the second member 52 of the guide unit 50 of which both edges are held by the sub-frame 35.

Here, the method of fixing the second holder unit 40 to the third member 56 and the fourth member 57 is the same as the method of fixing the first holder unit 30 to the first member 51 and the second member 52. In the following, a structure in which the first holder unit 30 is fixed will be described, and the description of the structure in which the second holder unit 40 is fixed will be omitted.

As shown in FIG. 3, the medium delivery unit 26 includes the first holder unit 30, the guide unit 50, and the lifting mechanism 20. As described above, the first holder unit 30 includes the fitting unit 13 fitting into the core opening 12 of the roll core 11 of the roll medium R and pivotably holds both edge portions of the roll medium R. The guide unit 50 includes the first member 51 and the second member 52. The first holder unit 30 is movably supported by the guide unit 50. Further, the lifting mechanism 20 (base unit 60) is also movably supported by the guide unit 50.

The first holder unit 30 includes a knob portion 36 formed of a screw with a knob. Then, by rotating the knob portion 36 in the direction of loosening the screw, it is possible to move the first holder unit 30 with respect to the first member 51 and the second member 52. Specifically, a base unit 4 is disposed below the first holder unit 30, and the base unit 4 moves with respect to the first member 51 and the second member 52. On the other hand, by rotating the knob portion 36 in the direction of tightening the screw, it is possible to fix the first holder unit 30 with respect to the first member 51 and the second member 52. Therefore, it is possible to adjust the position of the first holder unit 30 according to the width size of the roll medium R.

The lifting mechanism 20 is movably provided with respect to the first member 51 and the second member 52 between the pair of first holder units 30. The movement of the base unit 60 with respect to the guide unit 50 (the first member 51 and the second member 52) will be described below. As long as the lifting mechanism 20 (base unit 60) may be moved downward in the vicinity of the side edge of the roll medium R according to the size of the roll medium R and the side edge of the roll medium R may be lifted and lowered, it is not necessary to configure the lifting mechanism 20 to switch between a movable state and a fixed state with respect to the guide unit 50.

Figure 4:
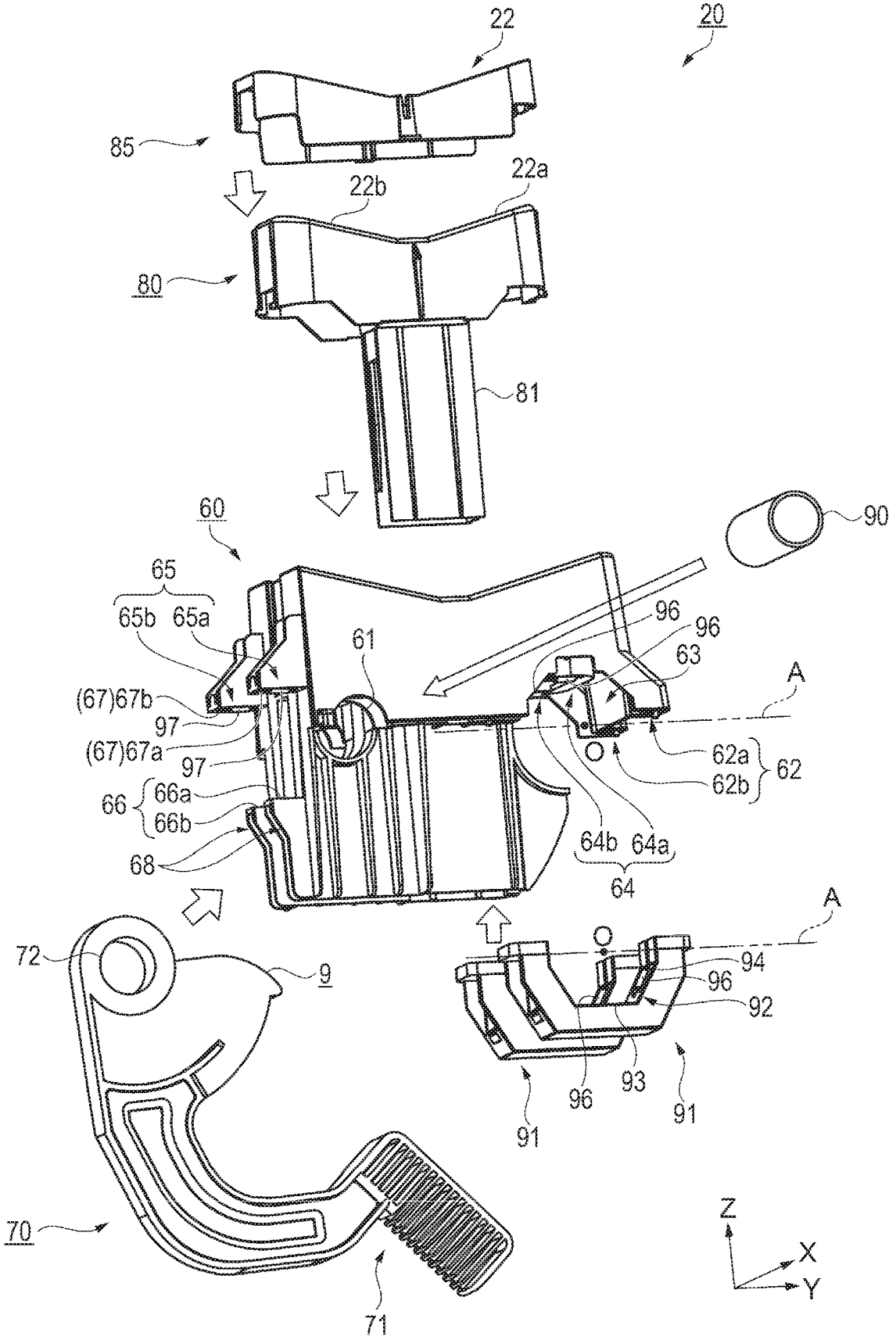
FIG. 4 is a perspective view showing an assembling method of the lifting mechanism.

As described above, the lifting mechanism 20 includes the base unit 60, the operation lever 70, the lifting unit 80, and the cam unit 9 (refer to FIG. 4). The base unit 60 is movably disposed with respect to the first member 51 and the second member 52 that constitute the guide unit 50. The lifting unit 80 is movably disposed with respect to the base unit 60 in the height direction Z. A placement unit 22 on which the roll medium R is placed is provided on an upper surface of the base unit 60 and an upper surface of the lifting unit 80. In the present embodiment, the upper surface of the base unit 60 is approximately as high as the upper surface of the lifting unit 80 in the state where the lifting unit 80 is lowered. Even if the placement unit 22 is configured with the upper surface of the lifting unit 80 only, it is possible to achieve the function of the placement unit 22.

The placement unit 22 is formed such that both sides thereof are high relative to the center when viewed in the axial direction (width direction X) of the first member 51 and the second member 52. In other words, the upper surface of the placement unit 22 is formed such that two upper side portions 22*a* and 22*b* contacting with the roll medium R look V-shaped. In this way, it is possible to prevent the rolling of the roll medium R and to stabilize the position of the roll medium R when the roll medium R is placed on the placement unit 22. The upper surface of the placement unit 22 may be formed to look U-shaped when viewed in the axial direction (width direction X) of the first member 51 and the second member 52. In other words, the placement unit 22 may not be V-shaped or U-shaped as long as, when viewed in the axial direction (width direction X), the distance between the two upper side portions 22*a* and 22*b* shortens as they move downward and the two portions 22*a* and 22*b* contact with the outer circumferential surface of the roll medium R.

The operation lever 70 is pivotably disposed around a pivoting member 90 (refer to FIG. 4). Then, as will be described below in detail, using the principle of leverage, the operation lever 70 can move the lifting unit 80 upward with a small force.

An assembling method of the lifting mechanism 20 will be described.

Figure 5:
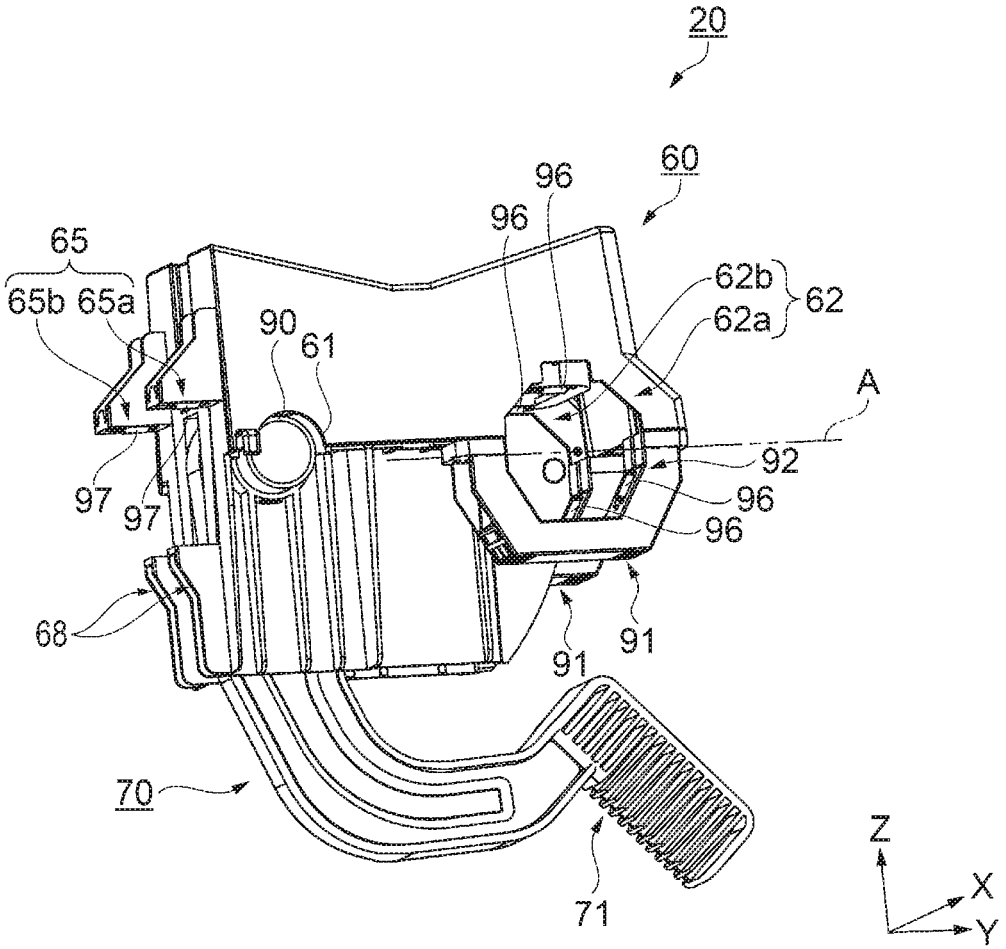
FIG. 5 is a perspective view showing the assembling method of the lifting mechanism.
Figure 6:
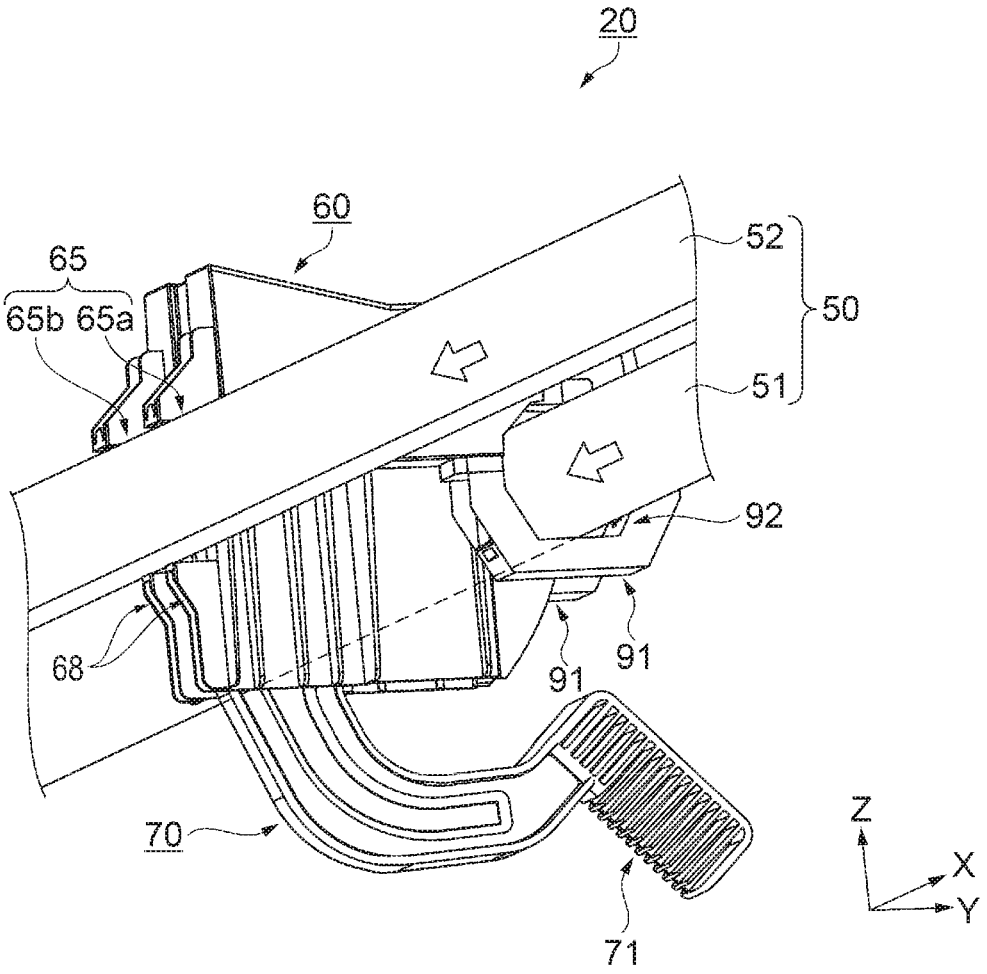
FIG. 6 is a perspective view showing the assembling method of the lifting mechanism.

FIGS. 4, 5, and 6 are perspective views showing an assembling method of the lifting mechanism 20.

Figure 7:
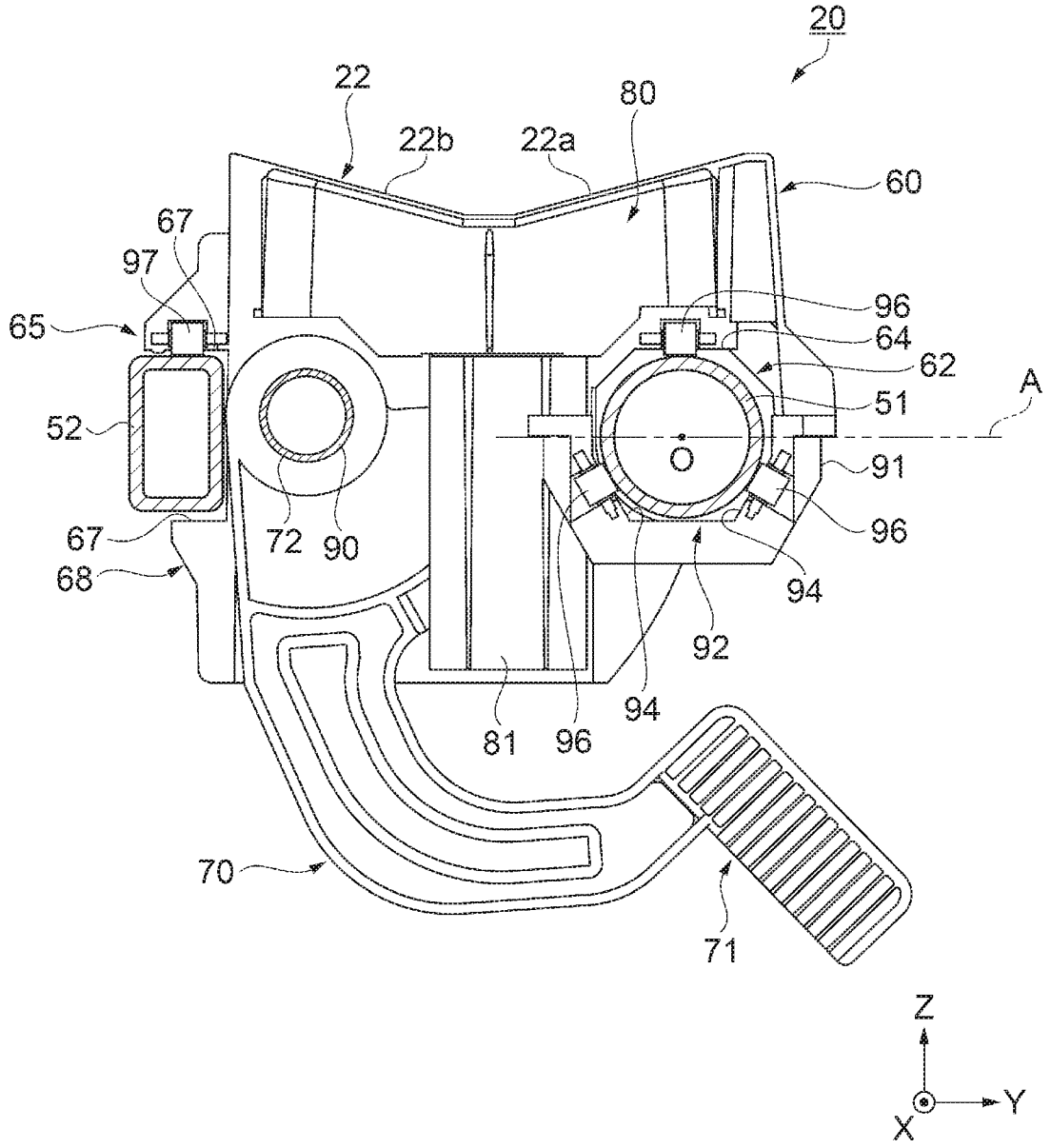
FIG. 7 is a side sectional view showing a state of a shaft side rolling element and a guide side rolling element inside a base unit.

FIG. 7 is a side sectional view showing the state of a shaft side rolling element 96 and a guide side rolling element 97 inside the base unit 60.

As shown in FIG. 4, in the base unit 60, a holding hole portion 61 fixing the pivoting member 90 for pivoting the operation lever 70 penetrates in the width direction X. Further, a shaft side insertion portion 62 as an insertion portion, through which the first member 51 is inserted, is disposed on the apparatus front side of the base unit 60. The shaft side insertion portion 62 is provided in both edge portions of the base unit 60 in the width direction X respectively. The shaft side insertion portion 62 of the base unit 60 forms an upper side half of the insertion portion. The shaft side insertion portion 62 on the left side when viewed from the apparatus front side is referred to as a shaft side insertion portion 62*a* and the shaft side insertion portion 62 on the right side is referred to as a shaft side insertion portion 62*b*.

Further, in the shaft side insertion portion 62 (62*a* and 62*b*), an insertion hole 63 penetrating in the width direction X is formed. Further, the shaft side insertion portion 62 (62*a* and 62*b*) includes an inner circumferential portion 64 respectively. Regarding the inner circumferential portion 64, the inner circumferential portion 64 on the left side when viewed from the apparatus front side is referred to as an inner circumferential portion 64*a* and the inner circumferential portion 64 on the right side is referred to as an inner circumferential portion 64*b*.

The insertion hole 63 is formed to include a shape of an octagonal upper side half when viewed in the width direction X. The inner circumferential portion 64 is disposed to face the outer circumferential portion (outer circumferential surface) of the first member 51 when the first member 51 as a shaft member is inserted through the shaft side insertion portion 62 (insertion hole 63). Specifically, the inner circumferential portion 64 (64*a* and 64*b*) extends inward in a state where each side of the octagonal shape formed in both edge portions of the insertion hole 63 in the width direction X is parallel to the width direction X.

Further, a guide side insertion portion 65 as an insertion portion through which the second member 52 is inserted is disposed on the apparatus rear side of the base unit 60. The guide side insertion portion 65 is provided in both edge portions of the base unit 60 in the width direction X respectively. The guide side insertion portion 65 on the right side when viewed in the apparatus rear side is referred to as a guide side insertion portion 65*a* and the guide side insertion portion 65 on the left side is referred to as a guide side insertion portion 65*b*.

In the guide side insertion portion 65, a portion of the guide side insertion portion 65 serving as a lower side is referred to as a protrusion portion 68. The protrusion portion 68 is configured to protrude from the rear side of the base unit 60 together with the guide side insertion portion 65 on the upper side. The protrusion portion 68 is configured in a positional relationship to face the second member 52 of the guide unit 50 from the lower side in the height direction Z. Specifically, the protrusion portion 68 faces the outer circumferential surface of the second member 52 on the lower side.

Further, the guide side insertion portion 65 (65*a* and 65*b*) is configured to include an insertion hole 66 penetrating in the width direction X respectively. Further, the guide side insertion portion 65 (65*a* and 65*b*) is configured to include an inner circumferential portion 67 respectively. Regarding the insertion hole 66 and the inner circumferential portion 67, the insertion hole 66 and the inner circumferential portion 67 on the right side when viewed in the apparatus rear side are referred to as an insertion hole 66*a* and an inner circumferential portion 67*a*, and the insertion hole 66 and the inner circumferential portion 67 on the left side are referred to as an insertion hole 66*b* and an inner circumferential portion 67*b*.

The insertion hole 66 (66*a* and 66*b*) is not a closed hole and is formed in a shape in which one side (−Y direction) is open. Since the second member 52 to be inserted is a prismatic tube member, the insertion hole 66 is formed as a rectangular insertion hole with one side open in correspondence to the outer circumference.

The inner circumferential portion 67 is disposed to face the outer circumferential portion (outer circumferential surface) of the second member 52 when the second member 52 is inserted through the guide side insertion portion 65 (insertion hole 66). Specifically, the inner circumferential portion 67*a* is formed in a state where each side of the rectangular shape formed in both edge portions of the insertion hole 66*a* in the width direction X extends inward parallel to each other in the width direction X. Since the inner circumferential portion 67*b* is the same as the inner circumferential portion 67*a*, the description thereof is omitted.

A base unit support portion 91 which constitutes the lower half of the shaft side insertion portion 62 (62*a* and 62*b*) is fixed to the shaft side insertion portion 62 of the base unit 60.

The base unit support portion 91 is configured with two in correspondence to the two shaft side insertion portions 62*a* and 62*b* of the base unit 60. The two base unit support portions 91 are configured in the same manner. Further, a shaft side insertion portion 92 is disposed as an insertion portion through which the first member 51 is inserted in the base unit support portion 91. The shaft side insertion portion 92 forms the lower side half of the insertion portion.

Further, an insertion hole 93 penetrating in the width direction X is formed in the shaft side insertion portion 92. Further, the shaft side insertion portion 92 includes an inner circumferential portion 94. The insertion hole 93 is formed to include a shape of the octagonal lower half when viewed in the width direction X. The inner circumferential portion 94 is disposed to face the outer circumferential surface of the first member 51 when the first member 51 as a shaft member is inserted through the shaft side insertion portion 92 (insertion hole 93). Specifically, the inner circumferential portion 94 is formed in a state where each side of the octagonal shape formed at both edge portions of the insertion hole 93 in the width direction X extends continuously inward parallel to each other in the width direction X.

The two base unit support portions 91 are respectively fixed to the lower side of the shaft side insertion portion 62 (62*a* and 62*b*) in accordance with the insertion hole 63 of the shaft side insertion portion 62 (62*a* and 62*b*) of the base unit 60. By this assembling, the shaft side insertion portion 62 of the base unit 60 and the shaft side insertion portion 92 of the base unit support portion 91 are integrated. In this state, the insertion hole 63 and the insertion hole 93 are put together to form an octagonal hole shape when viewed in the width direction X.

As shown in FIGS. 4, 5, and 7, a plurality of the shaft side rolling elements 96 as rolling elements are disposed in the inner circumferential portion 64*a* of the shaft side insertion portion 62*a* and the inner circumferential portion 94 of the shaft side insertion portion 92. Specifically, the shaft side rolling elements 96 having rotation shafts orthogonal to the width direction X and the height direction Z are respectively disposed in both edge portions in the width direction X in the upper inner circumferential portion 64 of the shaft side insertion portion 62. The shaft side rolling element 96 uses a so-called roller having a rotation shaft.

As shown in FIG. 7, with respect to a straight line A (virtual straight line) which is orthogonal to the axial direction (width direction X) and the height direction Z of the apparatus and which passes through the center O of the first member 51 when viewed in the axial direction, the shaft side rolling element 96 is disposed in the inner circumferential portion 64*a* of the shaft side insertion portion 62*a* on the upper side of the straight line A in the height direction Z of the apparatus. Specifically, the shaft side rolling element 96, of which the rotation shaft is orthogonal to the width direction X and the height direction Z is disposed in the upper portion of the inner circumferential portion 64*a* in the vertical direction. Further, the shaft side rolling element 96 is disposed in the inner circumferential portion 94 of the shaft side insertion portion 92 on the lower side of the straight line A in the height direction Z when viewed in the axial direction. Specifically, the rotation shaft is made orthogonal to the width direction X (orthogonal to the straight line A) and each of the shaft side rolling elements 96 is disposed at a position, downward of the straight line A and inclined at an angle of 30 degrees from the horizontal plane, in the two inner circumferential portions 94 facing each other.

In other words, when a straight line A is defined as a line which is orthogonal to the axial direction (width direction X) and the apparatus height direction Z, and when the straight line A passes through a center of the shaft member, at least three rolling elements of the plurality of rolling elements 96 are disposed in the inner circumferential portion 94 of the shaft side insertion portion 62 above the straight line A in the apparatus height direction Z and in the inner circumferential portion 94 of the shaft side insertion portion 62 below the straight line A in the apparatus height direction Z.

Here, when considering an imaginal line connecting each of three rolling elements 96 and the center O of the first member 51, it is preferable that an angle between the imaginal lines is substantially 120 degrees. By this, the lifting mechanism 20 (base unit 60) can be supported by the first member 51 through three rolling elements 96 stably.

In the present embodiment, the three shaft side rolling elements 96 are disposed in the inner circumferential portion 64*a* and the inner circumferential portion 94 on the one hand. Further, the three shaft side rolling elements 96 are disposed in the inner circumferential portion 64*b* and the inner circumferential portion 94 on the other hand. In other words, the shaft side rolling elements 96 are arranged in parallel substantially in the axial direction (width direction X). Specifically, one of three shaft side rolling elements 96 is disposed in the inner circumferential portion 64*a*, and two of three shaft side rolling elements 96 is disposed in the inner circumferential portion 94. Similarly, one of three shaft side rolling elements 96 is disposed in the inner circumferential portion 64*b*, and two of three shaft side rolling elements 96 are disposed in the inner circumferential portion 94. In other words, one of the plurality of rolling elements 96 is disposed in the inner circumferential portion 64 of the shaft side insertion portion 62 at an upper side of the straight line A in the apparatus height direction Z. In addition, two of the plurality of rolling elements 96 are disposed in the inner circumferential portion 64 of the shaft side insertion portion 62 at a lower side of the straight line A in the apparatus height direction Z. In other words, when viewed in the axial direction, one of the plurality of rolling elements 96 is disposed in the inner circumferential portion 94 of the shaft side insertion portion 62 above the straight line A in the apparatus height direction Z. In addition, when viewed in the axial direction, two of the plurality of rolling elements 96 are disposed in the inner circumferential portion 94 of the shaft side insertion portion 62 below the straight line A in the apparatus height direction Z.

As shown in FIG. 7, the plurality of shaft side rolling elements 96 are disposed to protrude, when viewed in the axial direction in which the first member 51 as a shaft member extends, from the inner circumferential portion 64 of the shaft side insertion portion 62 and the inner circumferential portion 94 of the shaft side insertion portion 92 in the axial direction of the first member 51. In this way, predetermined gaps are formed between the inner circumferential portions 64 and 94 and the outer circumferential surface of the first member 51. The three shaft side rolling elements 96 are configured to support the outer circumferential surface of the first member 51 in three directions. Then, the shaft side rolling elements 96 can roll on the outer circumferential surface of the first member 51 in the axial direction.

The guide side rolling element 97 as a rolling element is disposed in the inner circumferential portion 67*a* of the guide side insertion portion 65*a*. Specifically, one guide side rolling element 97, of which the rotation shaft is orthogonal to the width direction X and the height direction Z (in other words, parallel to the depth direction Y), is disposed in the upper inner circumferential portion 67*a* of the guide side insertion portion 65*a*.

As shown in FIG. 7, the guide side rolling element 97 is disposed to protrude from the upper inner circumferential portion 67 (67*a* and 67*b*) of the guide side insertion portion 65 (65*a* and 65*b*) when viewed in the axial direction in which the second member 52 as a guide member extends. In this way, a predetermined gap is formed between the inner circumferential portion 67 (67*a* and 67*b*) and the outer circumferential surface of the second member 52. The guide side rolling element 97 uses a so-called roller having a pivoting shaft. This one guide side rolling element 97 is configured to support the outer circumferential surface of the second member 52 in one direction. Then, the guide side rolling element 97 can roll on the outer circumferential surface of the second member 52 in the axial direction. The lifting mechanism 20 (base unit 60) is supported by the first member 51 and the second member 52 through the guide side rolling element 97.

Figure 8:
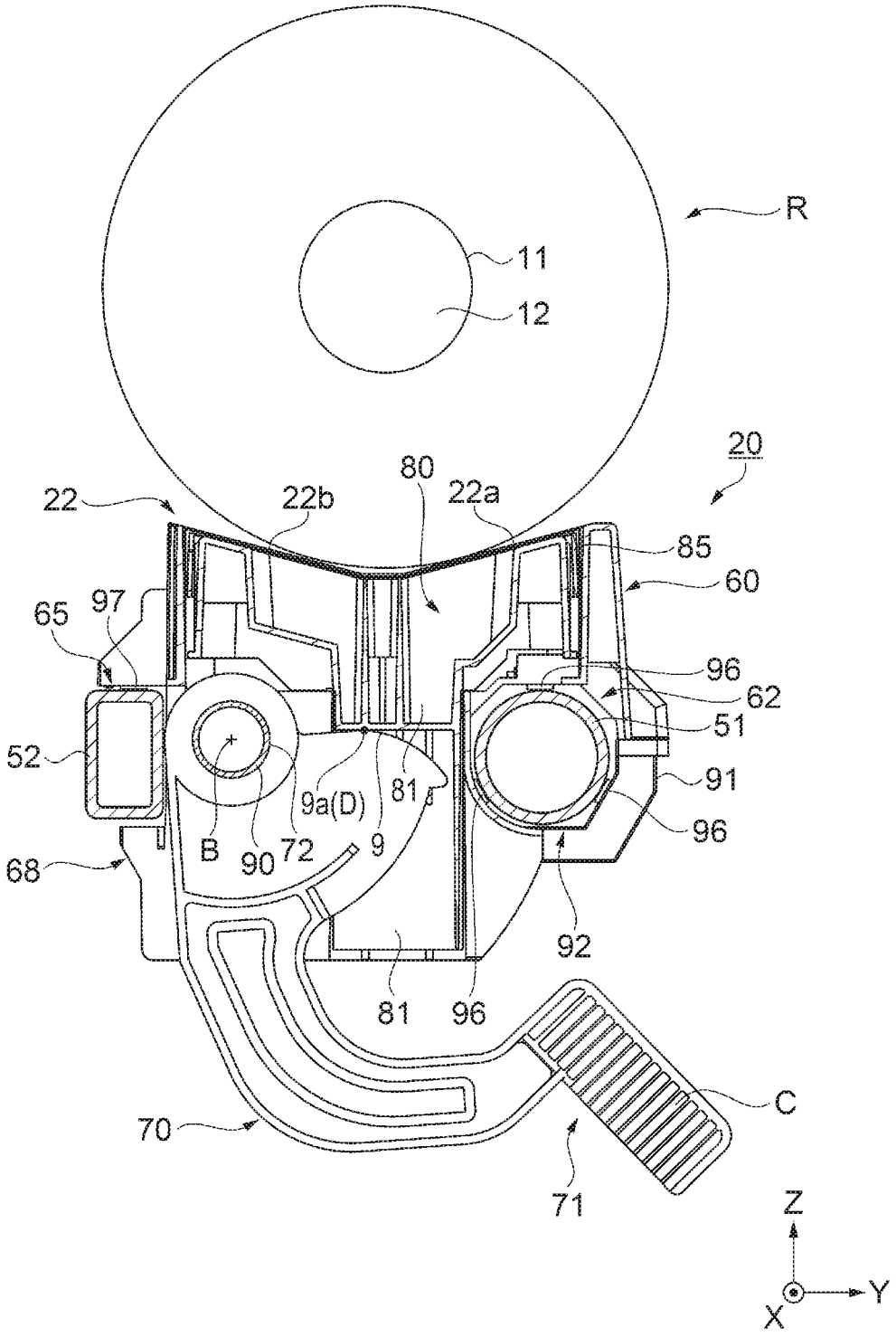
FIG. 8 is a side sectional view showing a state of an operation lever inside the base unit.

As shown in FIG. 8, the operation lever 70 includes a grip portion 71, a hole portion 72, and the cam unit 9. The operation lever 70 is positioned inside the base unit 60 so that the cam unit 9 is stored inside the base unit 60. Then, the hole portion 72 of the operation lever 70 is aligned with the holding hole portion 61 included in the base unit 60. Next, the pivoting member 90 as a pivoting shaft formed of a cylindrical tube member is inserted through the holding hole portion 61 from the outside of the base unit 60 and the pivoting member 90 is fixed to the base unit 60 (holding hole portion 61). In this state, the inner circumferential surface of the hole portion 72 of the operation lever 70 and the outer circumferential surface of the pivoting member 90 are configured to slide. In this configuration, the operation lever 70 is enabled to pivot around the pivoting member 90 (fulcrum).

As shown in FIG. 5, the operation lever 70 is supported by the base unit 60. Then, the shaft side insertion portions 62 and 92 are positioned on one side and on the other side in the width direction X (right/left direction) with respect to the operation lever 70. Further, the guide side insertion portion 65 is positioned on one side and on the other side in the width direction X (right/left direction) with respect to the operation lever 70 in the same manner. Further, three shaft side rolling elements 96 are respectively disposed in the inner circumferential portions 64 and 94 of the shaft side insertion portions 62 and 92 divided in the width direction X. Further, one guide side rolling element 97 is disposed in the upper inner circumferential portion 67 of the guide side insertion portion 65 divided in the width direction X.

In the present embodiment, the cam unit 9 is integrally configured to be linked to the operation lever 70. The cam unit 9 converts the pivoting movement of the operation lever 70 into a movement of the lifting unit 80 in the height direction Z.

The cam unit 9 may be configured to be separate from the operation lever 70 and be linked to the operation lever 70 when operated as long as the pivoting movement of the operation lever 70 can be converted into the movement of the lifting unit 80 in the height direction Z.

As shown in FIG. 4, the lifting unit 80 is covered with a cover member 85 from above. Then, the cover member 85 and the lifting unit 80 are attached to the base unit 60 from above so that a cam reception portion 81 included in the lifting unit 80 is stored inside the base unit 60 and the cam reception portion 81 contacts with the cam unit 9 (refer to FIG. 8).

Next, as shown in FIG. 6, the first member 51 as a shaft member is inserted through the shaft side insertion portion 62 as an insertion portion of the base unit 60. Further, in the same manner, the second member 52 as a guide member is inserted through the guide side insertion portion 65 as an insertion portion. In this state, by moving the base unit 60 with respect to the first member 51 and the second member 52, it is possible to move the lifting mechanism 20 in the width direction X of the roll medium R, in which the first member 51 and the second member 52 extend.

As described above, it is possible to assemble the lifting mechanism 20 easily.

As shown in FIG. 7, when the base unit 60 (lifting mechanism 20) moves with respect to the first member 51, the base unit 60 moves in the width direction X as the three shaft side rolling elements 96 included in the shaft side insertion portions 62*a* and 92 and the shaft side insertion portions 62*b* and 92 respectively pivot in contact with the first member 51. In this case, the three shaft side rolling elements 96 do not necessarily abut to the first member 51 all the time, but any one of the shaft side rolling elements 96 may pivot in contact with the first member 51.

Further, as shown in FIG. 7, when the base unit 60 (lifting mechanism 20) moves with respect to the second member 52, the base unit 60 moves in the width direction X as one guide side rolling element 97, respectively included in the guide side insertion portion 65*a* and the guide side insertion portion 65*b* on the upper side, pivots in contact with the second member 52.

As described above, the base unit 60 (lifting mechanism 20) moves with respect to the first member 51 and the second member 52.

FIG. 8 is a side sectional view showing the state of the operation lever 70 inside the base unit 60. FIG. 8 shows a state where the roll medium R is placed on the placement unit 22 and a state before the operation lever 70 is operated (state before the roll medium R is lifted) and shows the positional relationship of the cam unit 9 of the operation lever 70 and the lifting unit 80 (cam reception portion 81).

As shown in FIG. 8, the lifting unit 80 is incorporated inside the base unit 60 and guided by the operation lever 70 in the vertical direction (height direction Z). Further, the placement unit 22, on which the roll medium R is placed, is provided above the lifting unit 80. The cam reception portion 81 provided below the lifting unit 80 contacts with the cam unit 9 of the operation lever 70. The cover member 85 covers the gap between the lifting unit 80 and the base unit 60 when the lifting unit 80 lifts.

The operation (motion) of the lifting mechanism 20 will be described. The procedure (method) of attaching the roll medium R to the first holder unit 30 using the lifting mechanism 20 will be described.

It is assumed that the roll medium R is placed on the placement unit 22 of the two lifting mechanisms 20. The procedure of attaching the roll medium R to the first holder unit 30 in the present embodiment will be briefly described. First, the operation lever 70 is gripped and pivoted with respect to the lifting mechanism 20 on the side of one first holder unit 30 serving as the reference, and the position of the roll medium R on one edge side is aligned with the height position of the fitting unit 13 of the one first holder unit 30. Next, the pivoted operation lever 70, while being gripped, is moved along the guide unit 50 to the side of the first holder unit 30 serving as the reference, and the core opening 12 is fitted into the fitting unit 13.

Next, the operation lever 70 is gripped and pivoted with respect to the other lifting mechanism 20, and the position of the roll medium R on the other edge side is aligned with the height position of the fitting unit 13 of the other first holder unit 30. Next, the other first holder unit 30 is moved and the fitting unit 13 is fitted into the core opening 12. It is possible to attach the roll medium R to the first holder unit 30 by this procedure.

Figure 9:
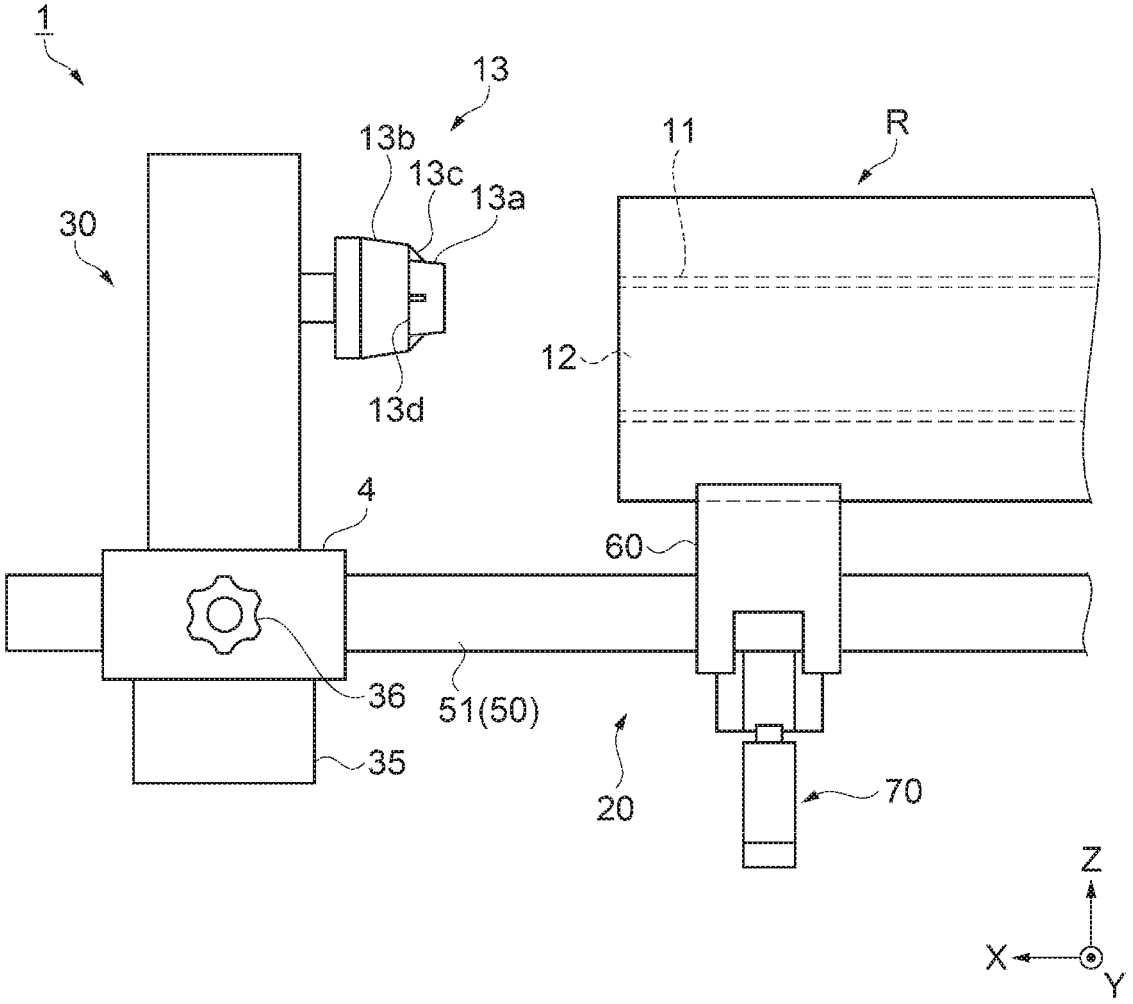
FIG. 9 is a front view showing the first holder unit before a roll medium is lifted.

FIG. 9 is a front view showing the first holder unit 30 before the roll medium R is lifted. FIG. 9 shows the one first holder unit 30 serving as the reference for determining the reference position of the roll medium R in the width direction X within a pair of the first holder units 30. In the present embodiment, the one first holder unit 30 serving as the reference is the first holder unit 30 on the left side (+X direction) of the apparatus. Since the configuration of the other first holder unit 30 on the right side (−X direction) of the apparatus is the same, the one first holder unit 30 will be described and the description of the other one will be omitted.

The fitting unit 13 according to the present embodiment includes a first support portion 13*a*, a second support portion 13*b*, an inclined portion 13*c*, and a step 13*d*. The first support portion 13*a* fits into the core opening (12) of the roll core (11) of the roll medium (R) whose size of the core opening equals a first size and supports the first size roll medium (R). On the other hand, the second support portion 13*b* fits into the core opening 12 of the roll core 11 of the second size roll medium R, of which the core opening is larger than the first size, and supports the second size roll medium R.

The first support portion 13*a* and the second support portion 13*b* are slightly inclined with respect to the width direction X so as to gradually narrow toward the tip edge side (roll medium R side) of the fitting unit 13. That is, they are slightly inclined like an outer circumferential surface of a cone. Further, the step 13*d* is formed between the first support portion 13*a* and the second support portion 13*b*. Then, the inclined portion 13*c* is formed so that the first support portion 13*a* and the second support portion 13*b* are joined. By the inclined portion 13*c*, it is possible to smoothly fit the second support portion 13*b* of the fitting unit 13 into the core opening 12 of the roll core 11 of the second size roll medium R. In the present embodiment, the second size roll medium R will be described.

Figure 10:
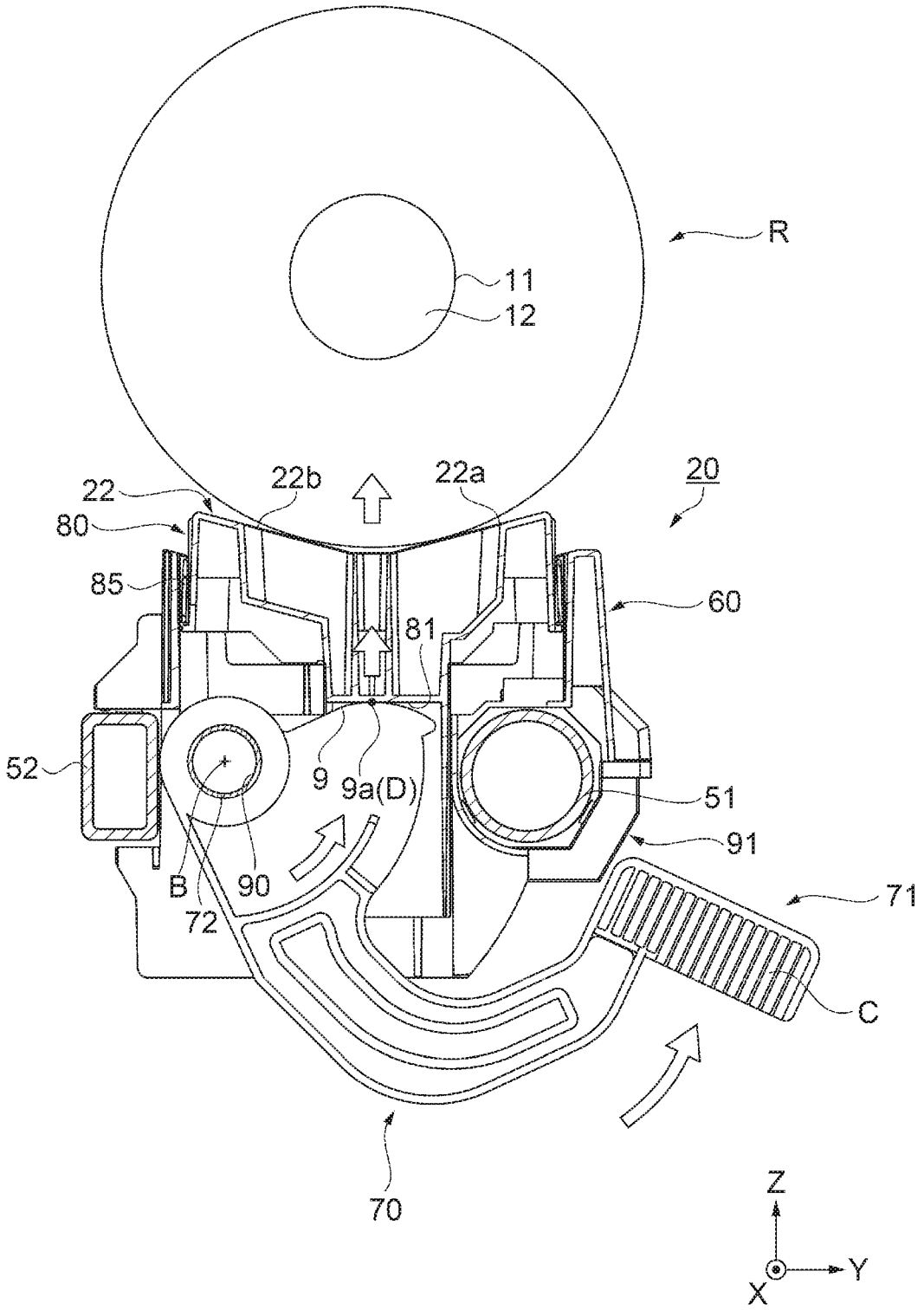
FIG. 10 is a side sectional view showing an operation in the middle of lifting the roll medium.
Figure 11:
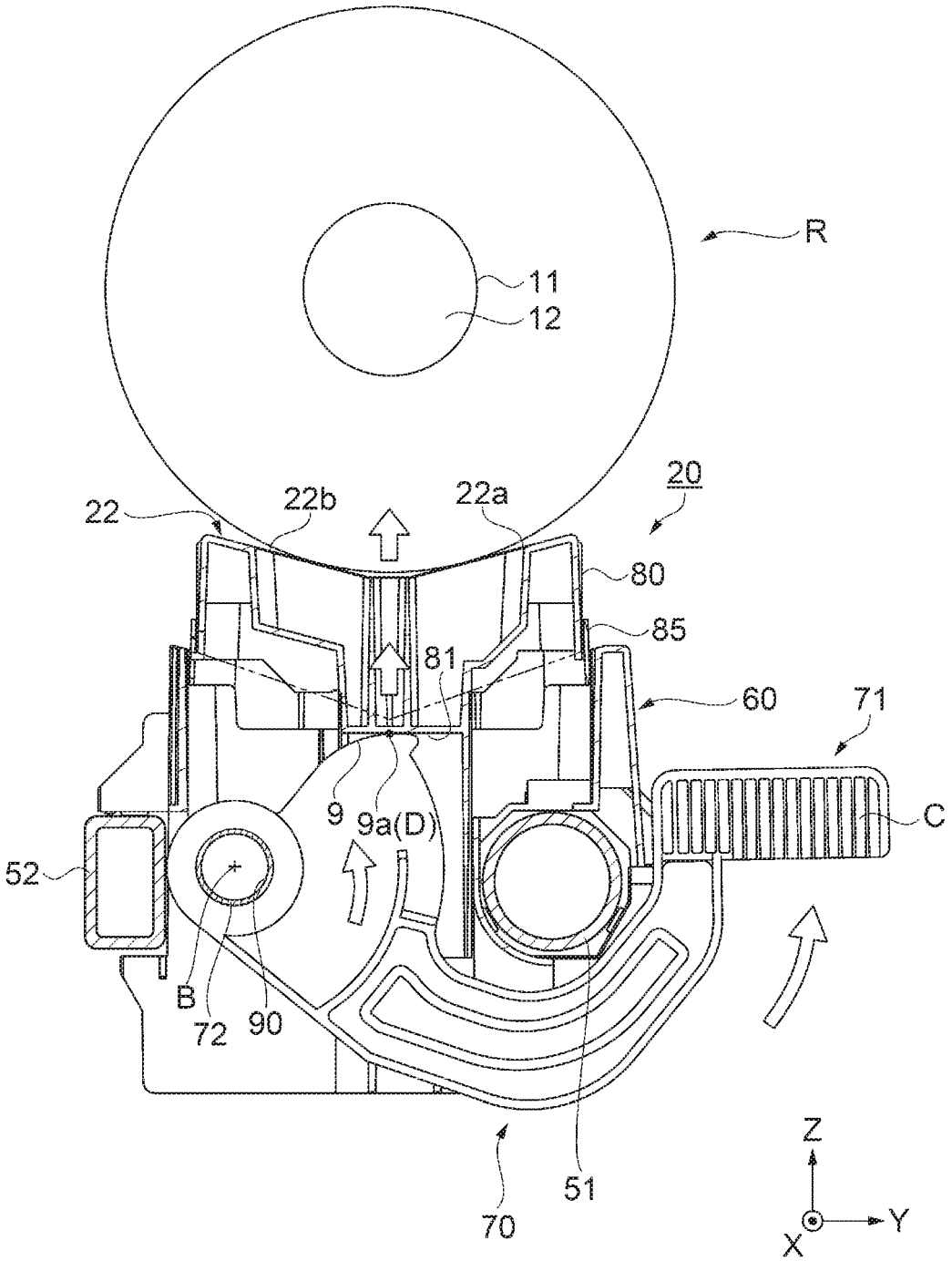
FIG. 11 is a side sectional view showing an operation of lifting the roll medium to a predetermined height.

FIG. 10 is a side sectional view showing an operation in the middle of lifting the roll medium R. FIG. 11 is a side sectional view showing an operation of lifting the roll medium R to a predetermined height.

In a state where the roll medium R is placed on the placement unit 22 as shown in FIGS. 8 and 9, the grip portion 71 of the operation lever 70 is gripped and pivoted counterclockwise in the figure around the pivoting member 90 as shown in FIG. 10. In this case, based on the principle of leverage, compared with the distance from the pivot point (fulcrum B) of the operation lever 70 to an action point D serving as a point 9*a* where the cam unit 9 abuts on the cam reception portion 81, the distance from the fulcrum B serving as a pivot point of the operation lever 70 to the force point C at which a force is applied to the operation lever 70 is made sufficiently long. Further, the action point D is on the force point C side with respect to the fulcrum B.

As shown in FIG. 10, the cam unit 9 pivots counterclockwise along with the pivoting of the operation lever 70. Then, since the action point D is on the force point C side with respect to the fulcrum B, the cam unit 9 exerts a force to push upward with respect to the cam reception portion 81 of the lifting unit 80 when the operation lever 70 is pivoted counterclockwise. In this way, the lifting unit 80 moves upward. Then, the lifting unit 80 moves the roll medium R upward. In this case, the lifting mechanism 20 can convert a relatively small force of a user into a large force and lift the heavy roll medium R upward by the principle of leverage.

The point 9*a* at which the cam unit 9 abuts on the cam reception portion 81 faces the moving direction (height direction Z) of the lifting unit 80. Therefore, the direction of the force the cam unit 9 exerts with respect to the cam reception portion 81 is the moving direction of the lifting unit 80. In other words, no lateral force acts in the moving direction of the lifting unit 80. Therefore, it is possible to reduce the frictional resistance between the lifting unit 80 and the base unit 60 as much as possible. As a result, it is possible to minimize the loss of the force, and it is possible to easily lift the roll medium R by as much.

The cam reception portion 81 is in a linear motion while the cam unit 9 is in a rotary motion. Therefore, friction is generated between the cam unit 9 and the cam reception portion 81, it is possible to make the friction almost uninfluential by smoothing the abutting point 9*a*.

In the state of FIG. 10, the operation lever 70 is further pivoted counterclockwise in the figure. Then, the cam unit 9 further pivots. In this way, the lifting unit 80 moves further upward. Then, the lifting unit 80 moves the roll medium R further upward. In this case, the cover member 85 attached between the lifting unit 80 and the base unit 60 abuts on the lifting unit 80 at a predetermined position. In the present embodiment, the outer surface of the lifting unit 80 abuts on the inner surface of the cover member 85.

Then, the operation lever 70 is further pivoted counterclockwise. Then, as shown in FIG. 11, the cam unit 9 further pivots, the lifting unit 80 moves further upward, and the lifting unit 80 moves the roll medium R further upward. In this way, the core opening 12 of the roll medium R is moved until the core opening 12 is positioned approximately at the height of the fitting unit 13 of the first holder unit 30 at a predetermined height.

At this time, the cover member 85 moves upward integrally with the lifting unit 80. Then, the cover member 85 closes the gap between the lifting unit 80 and the base unit 60 which is generated by the upward movement of the lifting unit 80. Therefore, it is possible to prevent an object from entering the gap or a hand from being inadvertently trapped in the gap. In particular, since the gap is generated when the moving distance of the lifting unit 80 is relatively long, the configuration to include the cover member 85 is effective.

Figure 12:
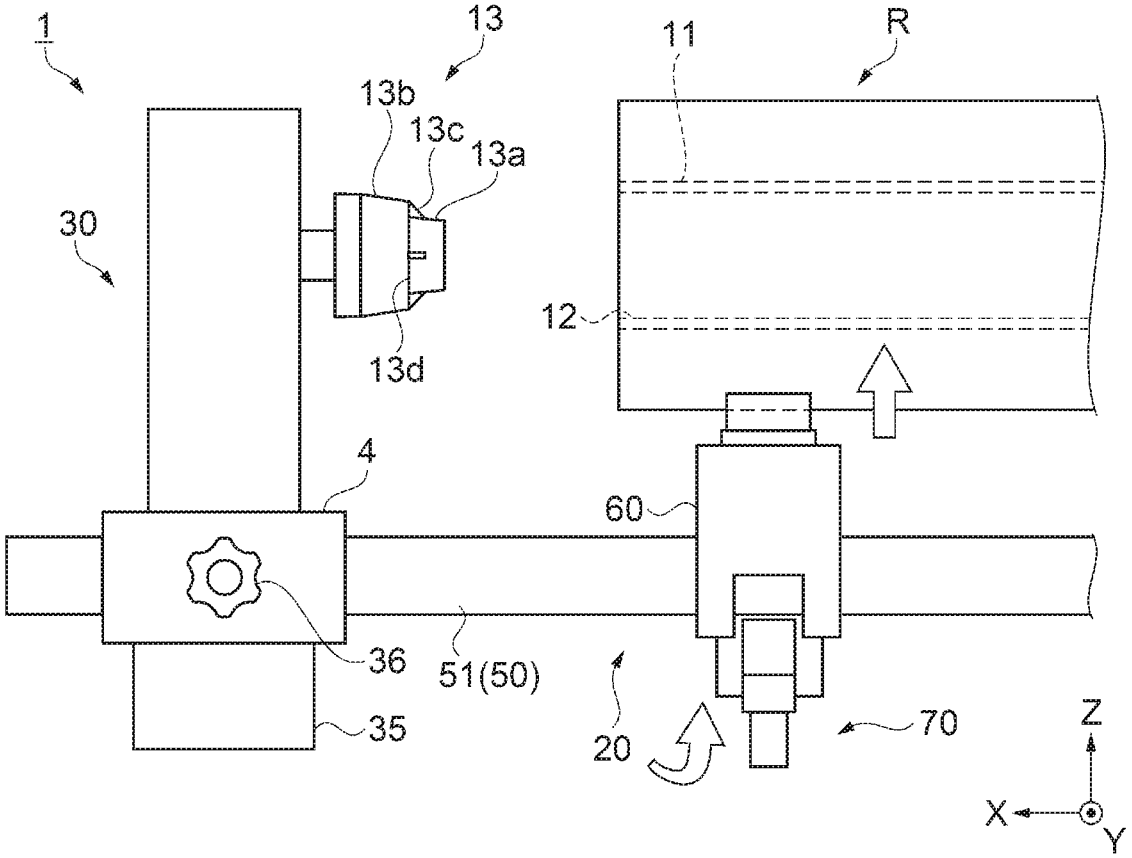
FIG. 12 is a front view showing a state in which the roll medium is lifted to the height of a fitting unit.
Figure 13:
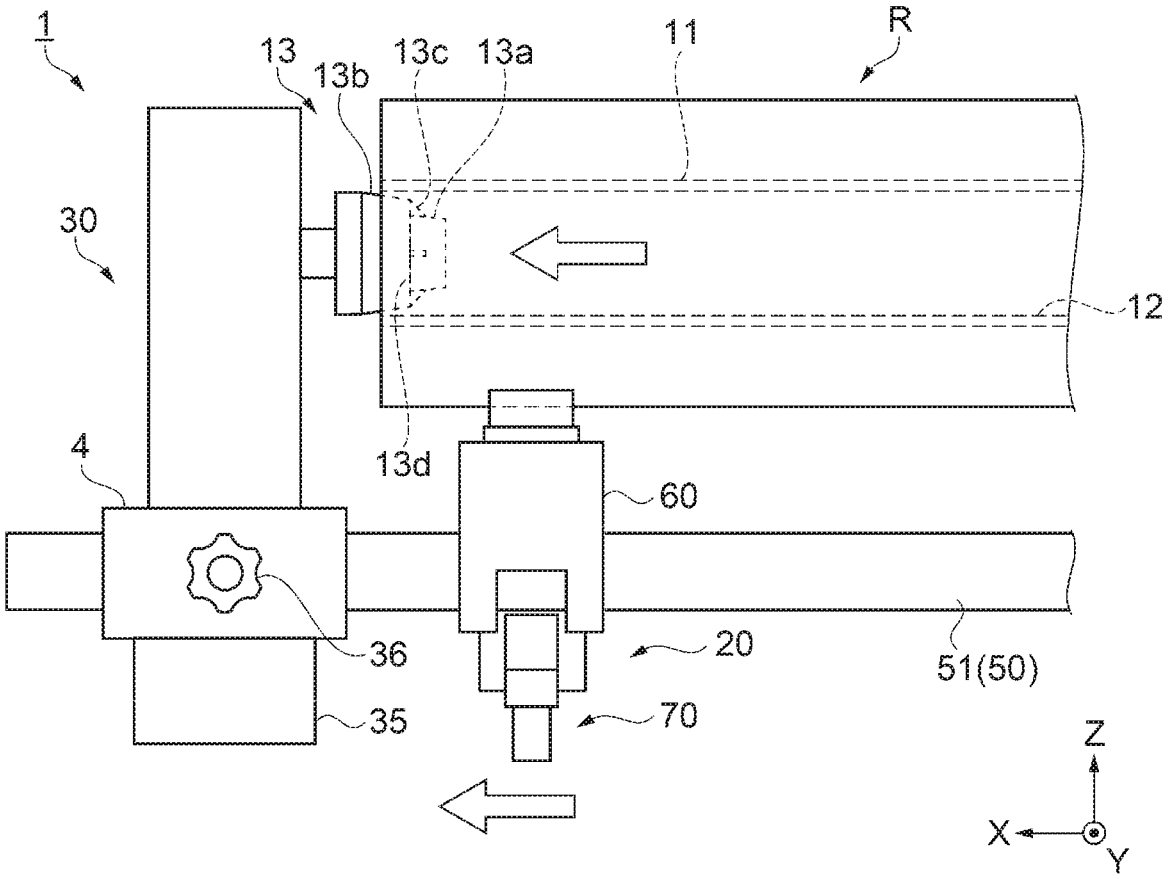
FIG. 13 is a front view showing a state of fitting with the fitting unit by moving the lifting mechanism.

FIG. 12 is a front view showing a state where the roll medium R is lifted to the height of the fitting unit 13. FIG. 13 is a front view showing a state of the fitting with the fitting unit 13 by moving the lifting mechanism 20.

As shown in FIG. 12, the operation lever 70 is pivoted such that the height of the fitting unit 13 of the one first holder unit 30 serving as the reference and the height of the core opening 12 of the roll core 11 of the roll medium R on one edge side facing the one first holder unit 30 serving as the reference is approximately the same.

Next, while the height of the roll medium R is maintained, the one lifting mechanism 20, on which the roll medium R on the one edge side is placed, is moved toward the one first holder unit 30 serving as the reference in a state where the operation lever 70 is gripped. At this time, the other lifting mechanism 20, on which the roll medium R on the other edge side is placed, moves along with the movement of the one lifting mechanism 20 by friction acting between the roll medium R and the placement unit 22 even if the operation lever 70 is not gripped. Then, the fitting unit 13 of the one first holder unit 30 serving as the reference is easily fitted into the core opening 12 of the roll core 11 on the one edge side.

Further, with a predetermined force, the user pushes the one lifting mechanism 20 toward the one first holder unit 30 serving as the reference in a state where the operation lever 70 is gripped. Then, as shown in FIG. 13, the second support portion 13*b* of the fitting unit 13 fits into the core opening 12 of the roll core 11 of the roll medium R on the one edge side.

When the roll medium R on the one edge side is attached to the one first holder unit 30 serving as the reference, the operation lever 70 may be released. When released, the operation lever 70 returns to the original posture (refer to FIG. 7) and the lifting unit 80 lowers.

As described above, when the roll medium R is moved, specifically, in the rolling medium R, the height of the roll medium R on the one edge side becomes different from the height of the roll medium R on the other edge side. In other words, the roll medium R is inclined with respect to the axial direction. However, in the present embodiment, regarding the fitting of the core opening 12 of the roll medium R with the fitting unit 13, the structure is such that, for example, the inclination of the outer circumferential surfaces of the first support portion 13*a* and the second support portion 13*b* of the fitting unit 13 tolerates a degree of fitting to some extent. Therefore, even if the center position of the core opening 12 deviates from the center position of the fitting unit 13 more or less (even if the roll medium R is inclined), the fitting is not affected.

Next, regarding the roll medium R on the other edge side, the other lifting mechanisms 20 is operated in the same way as the above description such that the position of the core opening 12 of the roll medium R on the other edge side is aligned with the position of the fitting unit 13 of the other first holder unit 30. Then, the knob portion 36 of the other first holder unit 30 is pivoted and loosened, and this time, the other first holder unit 30 is moved toward the roll medium R on the other edge side. Then, the fitting unit 13 of the other first holder unit 30 is fitted into the core opening 12 of the roll medium R on the other edge side.

Thereafter, the knob portion 36 is pivoted and tightened and the other first holder unit 30 is fixed to the first member 51. Thereafter, the operation lever 70 of the other lifting mechanism 20 is released, the operation lever 70 returns to the original posture (refer to FIG. 7), and the lifting unit 80 lowers.

It is possible to attach the roll medium R to the first holder unit 30 by the above operation.

According to the above attachment method, it is possible for one person to attach the roll medium R to the first holder unit 30 by fitting the fitting unit 13 into the core opening 12 one by one. Further, by this attachment method, it is possible to attach while dealing with a difference in width size of the roll medium R such that the reference position (medium edge position) of the roll medium R in the width direction X is not moved.

By the cooperation of the two, the fitting of the core opening 12 of the roll medium R on the one edge side with the fitting unit 13 of the one first holder unit 30 serving as the reference and the fitting of the fitting unit 13 of the other first holder unit 30 with the core opening 12 of the roll medium R on the other edge side may be performed approximately at the same time.

Next, an operation of lowering the roll medium R attached to the first holder unit 30 will be described.

When the roll medium R, once attached, is used up, only the roll core 11 is left. However, since the roll core 11 is relatively light, there is no problem in removing it as it is. However, for example, a roll medium R of a different size, or a roll medium R of a different type is attached in some cases before the attached roll medium R is used up. In such a case, it is necessary to detach the heavy roll medium R, already attached, from the first holder unit 30 and lower it.

In this case, first, the operation lever 70 of the other lifting mechanism 20 is pivoted, the lifting unit 80 is moved upward to approach the roll medium R on the other edge side. Specifically, the lifting unit 80 is moved (raised) so that the placement unit 22 of the lifting unit 80 abuts on the attached roll medium R. Then, in a state where the placement unit 22 made to abut to the roll medium R on the other edge side, the other first holder unit 30 is moved outward in the width direction X and the fitting unit 13 of the other first holder unit 30 is detached from the core opening 12 of the roll medium R on the other edge side. Then, lowering the operation lever 70 of the other lifting mechanism 20 moves the lifting unit 80 downward.

Thereafter, the operation lever 70 of the one lifting mechanism 20 is pivoted and the lifting unit 80 is moved (raised) so that the placement unit 22 of the lifting unit 80 abuts on the roll medium R on the one edge side. At the same time, the core opening 12 of the roll medium R on the one edge side is detached from the fitting unit 13 of the one first holder unit 30 serving as the reference as the one lifting mechanism 20 is moved in the width direction X. Then, lowering the operation lever 70 of the one lifting mechanism 20 moves the lifting unit 80 downward.

It is possible to lower the roll medium R attached to the first holder unit 30 by the above operation.

In the above description, with the one first holder unit 30 serving as the reference as a reference, the roll medium R, facing the first holder unit 30, on the one edge side is moved by the one lifting mechanism 20 on which the roll medium R is placed to fit the core opening 12 of the roll medium R onto the fitting unit 13. However, when it is not necessary to use the one first holder unit 30 as the reference, the one first holder unit 30, like the other first holder unit 30, may be moved to the side of the roll medium R on the one edge side, placed on the one lifting mechanism 20, to fit the fitting unit 13 into the core opening 12.

Figure 14:
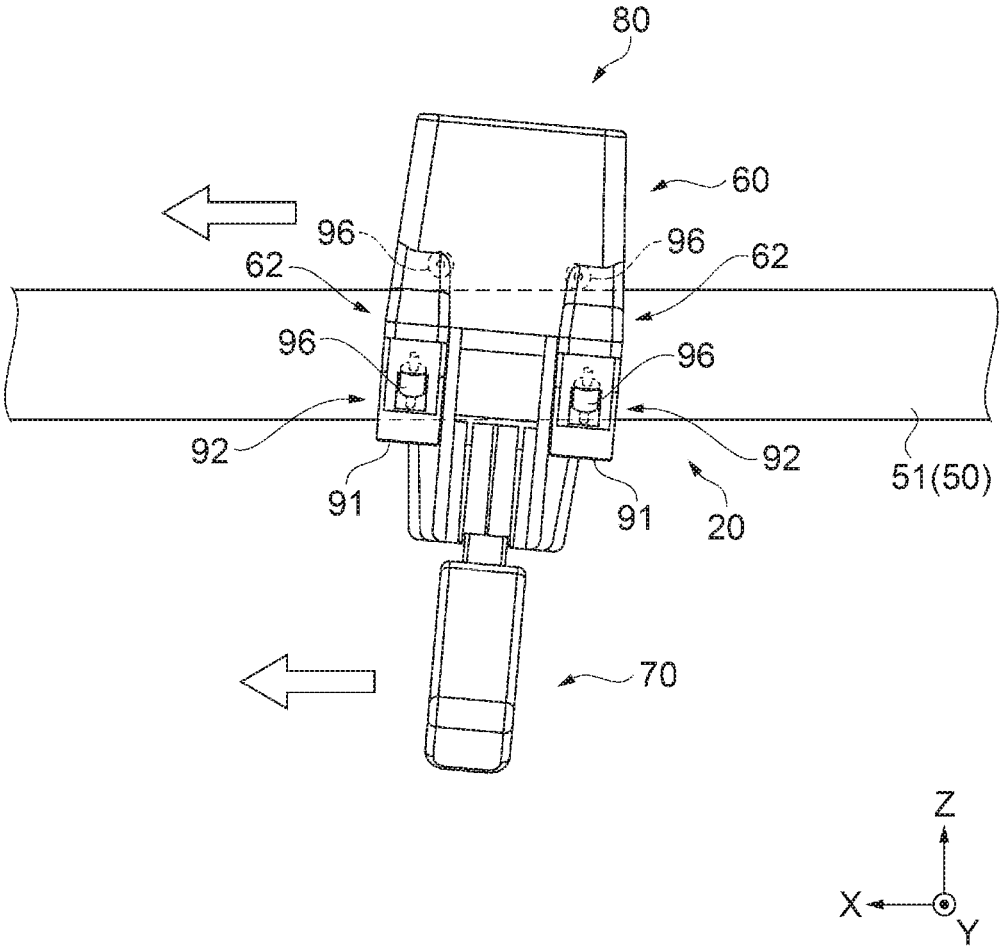
FIG. 14 is a schematic sectional view showing an inside of the base unit when the lifting mechanism is moved in a width direction.

FIG. 14 is a schematic sectional view showing the inside of the base unit 60 when the lifting mechanism 20 is moved in the width direction X. Details of the movement of the base unit 60 will be described with reference to FIGS. 14 and 7.

In the present embodiment, as described above, the one lifting mechanism 20 is moved with respect to the first member 51 and the second member 52 toward the fitting unit 13 of the one first holder unit 30 serving as the reference. In this case, specifically, the operation lever 70 is gripped and pivoted around the fulcrum B to align the height of the roll medium R with the height of the fitting unit 13 and, in this state, the operation lever 70 is moved toward the fitting unit 13 along the first member 51. As shown in FIG. 14, when such a movement is performed, the base unit 60 moves by the operation of the operation lever 70 in a state (so-called pried state) of being inclined due to the action of the forces rotating around the X, Y, and Z axes.

In the present embodiment, as shown in FIG. 7, the three shaft side rolling elements 96 are configured to support the outer circumferential surface of the first member 51 in three directions. Further, the two shaft side insertion portions 62 (92) having the three shaft side rolling elements 96 are disposed in the axial direction. Therefore, even in the case of movement in the pried state, it is possible to reduce the prying (inclination). Therefore, compared with the case in which the shaft side rolling element 96 is not used (the case of the related art), it is possible to reduce the friction resistance as possible and the movement with a small force is possible.

A result of a simulation conducted by the inventor is that, for example, when a roll medium R having a load of 60 kg is used, in other words, when a load of 30 kg is applied to the lifting mechanism 20 on one side, in the related art, a lifting mechanism configured to slide a guide unit yields a thrust load of 12 kg (friction coefficient is 0.4) without using the shaft side rolling element 96. In other words, a force of 12 kgf is needed to move (slide) a guide unit. Therefore, the configuration of the related art is considered to be incapable of sliding at all.

On the other hand, the configuration of the lifting mechanism 20 using the shaft side rolling element 96 according to the present embodiment yields a thrust load of 1.5 kg (frictional resistance is 0.05). In other words, it is possible to move with a force of 1.5 kgf. Therefore, it is possible to move even a heavy roll medium R with a light force.

The shaft side rolling element 96 may be provided in either of the one inner circumferential portion 64*a* and the other inner circumferential portion 64*b*. That is, the shaft side rolling element 96 may be provided in at least one of the one inner circumferential portion 64*a* and the other inner circumferential portion 64*b*. Further, it is preferable that at least one shaft side rolling element 96 is provided at a position overlapping with the first member 51 at least in the vertical direction parallel to the height direction Z. This is because the load applied to the lifting mechanism 20 is caused by the weight of the roll medium R and the load acts on a position overlapping with the first member 51 in the vertical direction. Therefore, it is possible to suppress the load applied to the lifting mechanism 20 as long as at least one shaft side rolling element 96 is provided at a position overlapping with the first member 51 in the vertical direction.

Further, as shown in FIG. 7, in the present embodiment, a gap is configured to be formed between the inner circumferential portions 64 and 94 of the shaft side insertion portions 62 and 92 and the first member 51. The gap is set so that, when the base unit 60 moves, the inner circumferential portions 64 and 94 of the shaft side insertion portions 62 and 92 do not abut to the outer circumferential surface of the first member 51 even in a case in which the base unit 60 is inclined (pried) with respect to the first member 51. That is, at least a part of the plurality of shaft side rolling elements 96 protrudes from the inner circumferential portions 64 and 94 of the shaft side insertion portions 62 and 92 so that it is possible to form the predetermined gap between the inner circumferential portions 64 and 94 of the shaft side insertion portions 62 and 92 and the first member 51. In this way, it is possible to prevent the inner circumferential portions 64 and 94 of the shaft side insertion portions 62 and 92 and the first member 51 from sliding in a firsthand contact with each other and to reduce the friction resistance when the lifting mechanism 20 is moved in the axial direction (width direction X) of the first member 51. Therefore, the friction resistance due to sliding is suppressed and the movement is facilitated even if the base unit 60 is inclined with respect to the first member 51 when the base unit 60 moves.

Further, in the related art, the pivoting member 90 serving as the fulcrum B of the operation lever 70 is a guide unit at the time of moving in the width direction X. However, in the present embodiment, the pivoting member 90 is used only as the fulcrum B of the operation lever 70, and the guide unit 50 at the time of moving is configured to use the first member 51 and the second member 52 serving as separate members from the pivoting member 90.

When the pivoting member 90 functions as a fulcrum of pivoting and also functions as a guide unit at the time of moving as in the related art, the operation lever 70 (lifting mechanism 20) gets in a state of being inclined (pried) with respect to the pivoting member 90 in a case in which the load of the roll medium R is heavy. In this configuration, when the operation lever 70 pivots with respect to the pivoting member 90, the operation lever 70 acts to roll around the pivoting member 90 to be in a state of being further inclined (pried). Therefore, the friction resistance becomes larger and it becomes difficult to move (slide) the operation lever 70 (lifting mechanism 20).

On the other hand, in the present embodiment, the fulcrum B of the operation lever 70 is composed of a member (pivoting member 90) separate from the guide unit 50. In other words, the first member 51 and the second member 52 constituting the guide unit 50 are configured not to be used as a shaft member serving as the fulcrum B of the operation lever 70.

As shown in FIG. 7, one guide side rolling element 97 is disposed in the upper inner circumferential portions 67 in the guide side insertion portion 65 (65*a* and 65*b*). According to this configuration, the guide side rolling element 97 receiving the load of the roll medium R is disposed on the upper side, so that it is possible to receive the load of the roll medium R efficiently and it is easy to move the base unit 60.

Further, as shown in FIG. 7, in the present embodiment, a gap is configured to be formed between the lower inner circumferential portion 67 (inner circumferential portion 67 of the protrusion portion 68) of the guide side insertion portion 65 and the lower outer circumferential surface of the second member 52. The gap is set such that, even if the base unit 60 is inclined (pried) with respect to the second member 52 at the time of moving, the lower outer circumferential surface of the second member 52 does not abut to the inner circumferential portion 67 of the protrusion portion 68. Therefore, even if the base unit 60 is inclined with respect to the second member 52 when the base unit 60 moves, the friction resistance due to sliding is suppressed and movement becomes easy.

Figure 15:
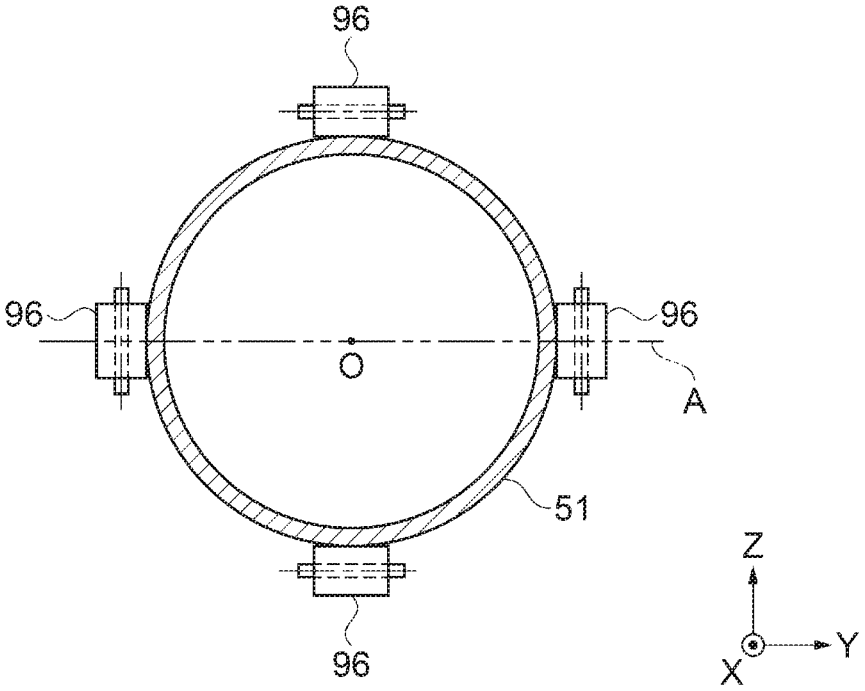
FIG. 15 is a side sectional view showing dispositions of shaft side rolling elements according to a modification example.
Figure 16:
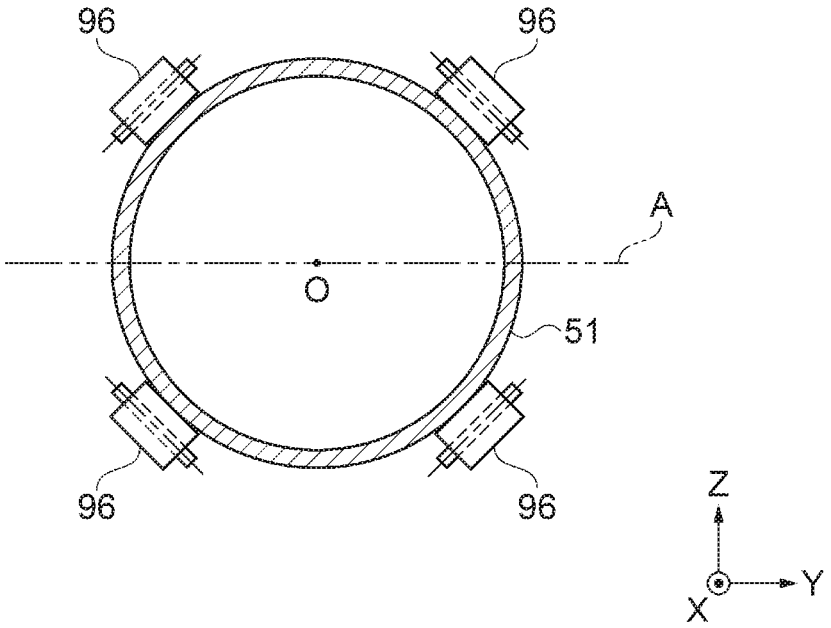
FIG. 16 is a side sectional view showing the dispositions of the shaft side rolling element according to the modification example.

FIGS. 15 and 16 are side sectional views showing disposation positions of the shaft side rolling element 96 according to a modification example. Specifically, FIGS. 15 and 16 show an arrangement relation of the shaft side rolling element 96 receiving the outer circumferential surface of the first member 51 of the guide unit 50.

In the present embodiment, as shown in FIG. 7, the three shaft side rolling elements 96 are configured to support the outer circumferential surface of the first member 51 in three directions. However, the method of disposing the shaft side rolling element 96 is not limited thereto.

As shown in FIG. 15, a total of four shaft side rolling elements 96 may be disposed, each one above in the vertical direction, right and left in the horizontal direction, and below in the gravity direction at an angle of approximately 90 degrees around the first member 51. Even in such a configuration, it is possible to receive the weight of the roll medium R efficiently, and it is possible to easily move the lifting mechanism 20 in the width direction X.

Further, as shown in FIG. 16, in contrast to the shaft side rolling elements 96 shown in FIG. 15, the shaft side rolling elements 96 may be disposed at the angle of 45 degrees respectively. In other words, a total of four shaft side rolling elements 96 may be disposed, two in the intermediate directions between the vertical direction and the horizontal direction and two in the intermediate directions between the gravity direction and the horizontal direction respectively. Even in such a configuration, it is possible to receive the weight of the roll medium R efficiently and it is possible to easily move the lifting mechanism 20 in the width direction X.

In the present embodiment, one shaft side rolling element 96 is disposed upward in the vertical direction and two are respectively disposed downward in the gravity direction at a position inclined at an angle of approximately 30 degrees from the horizontal direction around the first member 51. However, the disposation is not limited thereto. One shaft side rolling element 96 may be disposed downward in the gravity direction and two may be respectively disposed upward in the vertical direction at a position inclined at an angle of approximately 30 degrees from the horizontal direction around the first member 51. Further, a total of two shaft side rolling elements 96 may be disposed, with the first element therebetween, each one upward in the vertical direction at the positions inclined at an angle of approximately 30 degrees from the horizontal direction and none downward in the gravity direction.

In the present embodiment, the roll medium R is placed with the first holder unit 30 on the left side (+X direction) of the apparatus as a reference, but the present disclosure is not limited thereto. Both the first holder units 30 may be moved for the attachment of the roll medium R.

The lifting mechanism 20 according to the present embodiment applies to the medium delivery unit 26 but may apply to the medium rolling unit 37.

The lifting mechanism 20 according to the present embodiment includes the operation lever 70 and the cam unit 9 as a position adjustment unit. However, the present disclosure is not limited to this configuration. The lifting mechanism 20 may include a ball screw as a position adjustment unit so as to lift and lower the position of the lifting unit 80 in the apparatus height direction Z or may include a jack as a position adjustment unit so as to lift and lower the position of the lifting unit 80.

According to the printer 1 (recording apparatus) according to the present embodiment, it is possible to obtain the following effects.

According to the printer 1 of the present embodiment, the lifting mechanism 20 includes the lifting unit 80, the operation lever 70 pivoting around the pivoting member 90, the cam unit 9, and the base unit 60 supporting the lifting unit 80 and the pivoting member 90. The operation lever 70 and the cam unit 9 constitute the position adjustment unit. Further, the first member 51 supporting the base unit 60 is inserted through the base unit 60, the base unit 60 includes the shaft side insertion portions 62 and 92, and three shaft side rolling elements 96 are disposed in the inner circumferential portions 64 and 94 of the shaft side insertion portions 62 and 92. The shaft side rolling element 96 protrudes from the inner circumferential portions 64 and 94 when viewed in the axial direction of the first member 51.

In this configuration, when the user grips the operation lever 70 and moves the lifting mechanism 20 in the axial direction of the first member 51 in a state where the roll medium R is placed on the lifting unit 80, the inner circumferential portions 64 and 94 and the first member 51 do not contact with each other firsthand and the first member 51 and the shaft side rolling element 96 contact with each other, so that it is possible to reduce the friction resistance, compared with the case of a firsthand contact.

Further, at least a part of the three shaft side rolling elements 96 protrudes from the inner circumferential portions 64 and 94, so that it is possible to form a predetermined gap between the inner circumferential portions 64 and 94 and the first member 51. In this way, when the lifting mechanism 20 is moved in the axial direction of the first member 51, it is possible to prevent the inner circumferential portions 64 and 94 and the first member 51 from sliding in the firsthand contact with each other and it is possible to reduce the friction resistance.

Therefore, since it is possible to reduce the friction resistance even when the weight of the roll medium R increases, the roll medium R can be easily moved in the axial direction (width direction X) of the first member 51. Further, since the roll medium R can be easily moved in the width direction of the first member 51, in the present embodiment, it is possible to move the roll medium R to the first holder unit 30 on the left side (+X direction) of the apparatus, the unit serving as the reference position, so that it is possible to easily adjust the reference position (medium edge position) of the roll medium R. In this way, unlike the related art, the user does not need to reset the position of the first holder unit 30 caused by a deviation of the reference position of the roll medium R, and it is possible to eliminate the burden on the user.

According to the printer 1 of the present embodiment, with respect to a straight line A (virtual straight line) which is orthogonal to the axial direction (width direction X) and the height direction Z of the apparatus and which passes through the center O of the first member 51, the shaft side rolling element 96 is disposed on the upper side of the straight line A in the height direction Z in the inner circumferential portion 64*a* of the shaft side insertion portion 62*a*. Further, the shaft side rolling element 96 is disposed in the inner circumferential portion 94 of the shaft side insertion portion 92 on the lower side of the straight line A in the height direction Z. Specifically, the rotation shaft is made orthogonal to the width direction X (orthogonal to the straight line A) and each of the shaft side rolling elements 96 is disposed at a position, downward of the straight line A and inclined at an angle of 30 degrees from the horizontal plane, in the two inner circumferential portions 94 facing each other. In this way, the shaft side rolling elements 96 are composed of three rolling elements. In this configuration, it is possible to effectively disperse the load acting in the height direction Z while further suppressing the friction resistance due to the sliding between the inner circumferential portions 64 and 94 of the shaft side insertion portions 62 and 92 and the first member 51.

According to the printer 1 of the present embodiment, the three shaft side rolling elements 96 disposed on the inner circumferential portions 64*a* and 94 of the shaft side insertion portions 62*a* and 92 and the three shaft side rolling elements 96 disposed in the inner circumferential portions 64*b* and 94 of the shaft side insertion portions 62*b* and 92 are arranged in parallel substantially in the axial direction. In this configuration, when the lifting mechanism 20 is moved in the axial direction, the three shaft side rolling elements 96 arranged in parallel substantially in the axial direction receive forces at the respective abutting positions, so that prying hardly occurs even if the lifting mechanism 20 is inclined with respect to the first member 51.

According to the printer 1 of the present embodiment, the base unit 60 is supported by the insertion of the second member 52 together with the first member 51. The second member 52 is disposed at a predetermined distance from the first member 51. The base unit 60 includes the guide side insertion portion 65, and the guide side rolling element 97 configured to abut to the second member 52 from the upper side in the height direction Z is disposed in the inner circumferential portion 67 of the guide side insertion portion 65. According to this configuration, it is possible to suppress the sliding resistance caused by the firsthand contact of the lifting mechanism 20 with the second member 52.

According to the printer 1 of the present embodiment, the base unit 60 includes the protrusion portion 68 facing the second member 52 from the lower side in the height direction Z in the inner circumferential portion 67 of the guide side insertion portion 65. When the operation lever 70 is pivoted around the pivoting member 90, there is a possibility that the base unit 60 pivots around the pivoting member 90 in a case in which the protrusion portion 68 is not provided. However, in this configuration, in the base unit 60, it is possible to regulate the pivoting of the base unit 60 (lifting mechanism 20) around the pivoting member 90 even when the operation lever 70 is pivoted around the pivoting member 90.

Further, according to the lifting mechanism 20 according to the present embodiment, it is possible to obtain the following effects.

According to the lifting mechanism 20 of the present embodiment, the lifting unit 80, the operation lever 70 pivoting around the pivoting member 90, the cam unit 9, and the base unit 60 supporting the lifting unit 80 and the pivoting member 90 are provided. The operation lever 70 and the cam unit 9 constitute a position adjustment unit. Further, the first member 51 for supporting the base unit 60 is inserted through the base unit 60, the base unit 60 includes the shaft side insertion portions 62 and 92, and the three shaft side rolling elements 96 are disposed in the inner circumferential portions 64 and 94 of the shaft side insertion portions 62 and 92. The shaft side rolling elements 96 protrude from the inner circumferential portions 64 and 94 when viewed in the axial direction of the first member 51.

In this configuration, when the user grips the operation lever 70 and moves the lifting mechanism 20 in the axial direction of the first member 51 in a state where the roll medium R is placed on the lifting unit 80, the inner circumferential portions 64 and 94 and the first member 51 do not contact with each other firsthand and the first member 51 and the shaft side rolling element 96 contact with each other, so that it is possible to reduce the friction resistance, compared with the case of a firsthand contact.

Further, at least a part of the three shaft side rolling elements 96 protrudes from the inner circumferential portions 64 and 94, so that it is possible to form a predetermined gap between the inner circumferential portions 64 and 94 and the first member 51. In this way, when the lifting mechanism 20 is moved in the axial direction of the first member 51, it is possible to prevent the inner circumferential portions 64 and 94 and the first member 51 from sliding in the firsthand contact with each other and it is possible to reduce the friction resistance.

Therefore, since it is possible to reduce the friction resistance, the roll medium R is easily moved in the axial direction (width direction X) of the first member 51 even when the weight of the roll medium R increases. Further, since the roll medium R is easily moved in the width direction of the first member 51, in the present embodiment, it is possible to move the roll medium R to the first holder unit 30 on the left side (+X direction) of the apparatus serving as the reference position, so that it is possible to easily align the reference position (medium edge position) of the roll medium R. In this way, unlike the related art, the user does not need to reset the position of the first holder unit 30 caused by a deviation of the reference position of the roll medium R, and it is possible to eliminate the burden on the user.

According to the lifting mechanism 20 of the present embodiment, with respect to a straight line A (virtual straight line) which is orthogonal to the axial direction (width direction X) and the height direction Z of the apparatus and which passes through the center O of the first member 51, the shaft side rolling element 96 is disposed in the inner circumferential portion 64*a* of the shaft side insertion portion 62*a* on the upper side of the straight line A in the height direction Z. Further, the shaft side rolling element 96 is disposed in the inner circumferential portion 94 of the shaft side insertion portion 92 on the lower side of the straight line A in the height direction Z. Specifically, the rotation shaft is made orthogonal to the width direction X (orthogonal to the straight line A) and each of the shaft side rolling elements 96 is disposed at a position, downward of the straight line A and inclined at an angle of 30 degrees from the horizontal plane, in the two inner circumferential portions 94 facing each other. In this way, the shaft side rolling elements 96 are composed of three rolling elements. In this configuration, it is possible to effectively disperse the load acting in the height direction Z while further suppressing the friction resistance caused by the sliding between the inner circumferential portions 64 and 94 of the shaft side insertion portions 62 and 92 and the first member 51.

According to the lifting mechanism 20 of the present embodiment, the three shaft side rolling elements 96 disposed in the inner circumferential portions 64*a* and 94 of the shaft side insertion portions 62*a* and 92 and the three shaft side rolling elements 96 disposed in the inner circumferential portions 64*b* and 94 of the shaft side insertion portions 62*b* and 92 are arranged in parallel substantially in the axial direction. In this configuration, when the lifting mechanism 20 is moved in the axial direction, the three shaft side rolling elements 96 arranged in parallel substantially in the axial direction receive forces at the respective abutting positions, so that prying hardly occurs even if the lifting mechanism 20 is inclined with respect to the first member 51.

According to the lifting mechanism 20 of the present embodiment, the base unit 60 is supported by the insertion of the second member 52 together with the first member 51. The second member 52 is disposed at a predetermined distance from the first member 51. Then, the base unit 60 includes the guide side insertion portion 65, and the guide side rolling element 97 configured to abut to the second member 52 from the upper side in the height direction Z is disposed on the inner circumferential portion 67 of the guide side insertion portion 65. According to this configuration, it is possible to suppress the sliding resistance caused by the firsthand contact of the lifting mechanism 20 with the second member 52.

According to the lifting mechanism 20 of the present embodiment, the base unit 60 includes the protrusion portion 68 facing the second member 52 from the lower side in the height direction Z in the inner circumferential portion 67 of the guide side insertion portion 65. When the operation lever 70 is pivoted around the pivoting member 90, there is a possibility that the base unit 60 pivots around the pivoting member 90 in a case in which the protrusion portion 68 is not provided. However, in this configuration, in the base unit 60, it is possible to regulate the pivoting of the base unit 60 around the pivoting member 90 even when the operation lever 70 is pivoted around the pivoting member 90.

The contents derived from the embodiment described above will be described in the following.

The recording apparatus includes a lifting mechanism lifting and lowering a roll-shaped medium; the lifting mechanism lifts and lowers in the apparatus height direction and includes a lifting unit on which a roll-shaped medium is placed, a position adjustment unit configured to adjust a position of the lifting unit in the apparatus height direction, and a base unit supporting the lifting unit and the position adjustment unit; the base unit includes an insertion portion through which a shaft member supporting the base unit is inserted and which includes an inner circumferential portion facing an outer circumferential portion of the shaft member; a plurality of rolling elements are disposed in the inner circumferential portion of the insertion portion; and a plurality of rolling elements protrude from the inner circumferential portion of the insertion portion when viewed in the axial direction in which the shaft member extends.

According to this configuration, the recording apparatus includes the lifting mechanism lifting and lowering the roll-shaped medium. The lifting mechanism includes the lifting unit, the position adjustment unit, the base unit, and the shaft member. The base unit includes the insertion portion, and a plurality of rolling elements are disposed in the inner circumferential portion of the insertion portion. Further, the plurality of rolling elements protrude from the inner circumferential portion of the insertion portion when viewed in the axial direction in which the shaft member extends.

In the recording apparatus configured in this manner, when a user grips the position adjustment unit (for example, operation lever) and moves the lifting mechanism in the axial direction of the shaft member in a state where the roll-shaped medium is placed on the lifting unit, the plurality of rolling elements disposed in the inner circumferential portion of the insertion portion reduce the friction resistance, compared with the case in which the inner circumferential portion of the insertion portion and the shaft member slide in the firsthand contact with each other.

Further, at least a part of the plurality of rolling elements protrudes from the inner circumferential portion of the insertion portion, so that it is possible to form a predetermined gap between the inner circumferential portion of the insertion portion and the shaft member. In this way, when the lifting mechanism is moved in the axial direction of the shaft member, it is possible to prevent the inner circumferential portion of the insertion portion and the shaft member from sliding in the firsthand contact with each other and it is possible to reduce the friction resistance.

Therefore, since it is possible to reduce the friction resistance, the roll-shaped medium is easily moved in the axial direction (width direction) of the shaft member even when the weight of the roll-shaped medium increases.

In the recording apparatus described above, it is preferable that, with respect to a straight line which is orthogonal to the axial direction and the apparatus height direction and which passes through the center of the shaft member, a plurality of rolling elements are disposed in the inner circumferential portion of the insertion portion at an upper side of the straight line in the apparatus height direction and in the inner circumferential portion of the insertion portion at a lower side of the straight line in the apparatus height direction, where at least three rolling elements are disposed in the inner circumferential portion.

According to this configuration, when the roll-shaped medium is placed on the lifting unit, the load caused by the weight acts in the apparatus height direction. With respect to the straight line which is orthogonal to the axial direction and the apparatus height direction and which passes through the center of the shaft member, the rolling element is disposed in the inner circumferential portion of the insertion portion at the upper side of the straight line in the apparatus height direction and in the inner circumferential portion of the insertion portion at the lower side of the straight line in the apparatus height direction, where, furthermore, at least three rolling elements are disposed in the inner circumferential portion. Therefore, it is possible to effectively disperse the load acting in the apparatus height direction while further suppressing the sliding friction caused by the sliding of the inner circumferential portion of the insertion portion and the shaft member.

In the recording apparatus described above, it is preferable that a plurality of rolling elements are arranged in parallel substantially in the axial direction.

According to this configuration, when the lifting mechanism is moved in the axial direction by a plurality of rolling elements arranged in parallel substantially in the axial direction, the plurality of rolling elements arranged in parallel substantially in the axial direction receive forces at a plurality of abutting positions, so that prying hardly occurs even if the lifting mechanism is inclined with respect to the shaft member.

It is preferable that the recording apparatus described above includes a guide member which is disposed at a predetermined distance from the shaft member and which supports the lifting mechanism together with the shaft member; that the base unit includes a guide side insertion portion through which the guide member is inserted and which includes the inner circumferential portion facing the outer circumferential portion of the guide member; and that a guide side rolling element configured to abut to the guide member from an upper side in the apparatus height direction is disposed in the inner circumferential portion of the guide side insertion portion.

According to this configuration, it is possible to guide the movement of the lifting mechanism in the axial direction by the guide member, disposed at the predetermined distance from the shaft member and disposed parallel to the axial direction. Further, the base unit (lifting mechanism) includes the guide side rolling element configured to abut to the guide member from the upper side in the apparatus height direction. In this way, it is possible to suppress the sliding resistance caused by the firsthand contact of the lifting mechanism with the guide member.

In the recording apparatus described above, it is preferable that the base unit includes a protrusion portion facing the guide member from a lower side in the apparatus height direction in the inner circumferential portion of the guide side insertion portion.

According to this configuration, the lifting mechanism includes the guide side rolling element configured to abut to the guide member from the upper side in the apparatus height direction, and includes the protrusion portion facing the guide member from the lower side in the apparatus height direction. In this way, it is possible to regulate the pivoting of the lifting mechanism around the pivoting shaft even when the operation lever is pivoted around the pivoting shaft.

The lifting mechanism lifts and lowers in the apparatus height direction and includes a lifting unit on which a roll-shaped medium is placed, a position adjustment unit configured to adjust the position of the lifting unit in the apparatus height direction, and a base unit supporting the lifting unit and the position adjustment unit; the base unit includes an insertion portion through which a shaft member supporting the base unit is inserted and which includes an inner circumferential portion facing the outer circumferential portion of the shaft member; a plurality of rolling elements are disposed in the inner circumferential portion of the insertion portion; and the plurality of rolling elements protrude from the inner circumferential portion of the insertion portion when viewed in the axial direction in which the shaft member extends.

According to this configuration, the lifting mechanism lifts and lowers the roll-shaped medium and includes the lifting unit, the position adjustment unit, the base unit, and the shaft member. The base unit includes the insertion portion, and a plurality of the rolling elements are disposed in the inner circumferential portion of the insertion portion. Further, the plurality of rolling elements protrude from the inner circumferential portion of the insertion portion when viewed in the axial direction in which the shaft member extends.

In the lifting mechanism configured in this manner, when a user grips the position adjustment unit (for example, operation lever) and moves the lifting mechanism in the axial direction of the shaft member in a state where the roll-shaped medium is placed on the lifting unit, the plurality of rolling elements disposed in the inner circumferential portion of the insertion portion reduce the friction resistance, compared with the case in which the inner circumferential portion of the insertion portion and the shaft member slide in the firsthand contact with each other.

Further, at least a part of the plurality of rolling elements protrudes from the inner circumferential portion of the insertion portion, so that it is possible to form the predetermined gap between the inner circumferential portion of the insertion portion and the shaft member. In this way, when the lifting mechanism is moved in the axial direction of the shaft member, it is possible to prevent the inner circumferential portion of the insertion portion and the shaft member from sliding in the firsthand contact with each other and it is possible to reduce the friction resistance.

Therefore, since it is possible to reduce the friction resistance, the roll-shaped medium is easily moved in the axial direction (width direction) of the shaft member even when the weight of the roll-shaped medium increases.

In the lifting mechanism described above, it is preferable that, with respect to a straight line which is orthogonal to the axial direction and the apparatus height direction and which passes through a center of the shaft member, the plurality of rolling elements are disposed in the inner circumferential portion of the insertion portion at the upper side of the straight line in the apparatus height direction and in the inner circumferential portion of the insertion portion at the lower side of the straight line in the apparatus height direction, and at least three rolling elements are disposed in the inner circumferential portion.

According to this configuration, when the roll-shaped medium is placed on the lifting unit, the load caused by the weight acts in the apparatus height direction. With respect to the straight line which is orthogonal to the axial direction and the apparatus height direction and which passes through the center of the shaft member, the rolling element is disposed in the inner circumferential portion of the insertion portion at the upper side of the straight line in the apparatus height direction and in the inner circumferential portion of the insertion portion at the lower side of the straight line in the apparatus height direction, where, furthermore, at least three rolling elements are disposed in the inner circumferential portion. Therefore, it is possible to effectively disperse the load acting in the apparatus height direction while suppressing the sliding friction caused by the sliding of the inner circumferential portion of the insertion portion and the shaft member.

In the lifting mechanism described above, it is preferable that the plurality of rolling elements is arranged in parallel substantially in the axial direction.

According to this configuration, when the lifting mechanism is moved in the axial direction by the plurality of rolling elements arranged in parallel substantially in the axial direction, the plurality of rolling elements arranged in parallel substantially in the axial direction receive forces at a plurality of abutting positions, so that prying hardly occurs even if the lifting mechanism is inclined with respect to the shaft member.

It is preferable that the lifting mechanism described above includes a guide member which is disposed at a predetermined distance from the shaft member and which supports the base unit together with the shaft member; that the base unit includes a guide side insertion portion through which the guide member is inserted and which includes the inner circumferential portion facing the outer circumferential portion of the guide member; and that a guide side rolling element configured to abut to the guide member from an upper side in the apparatus height direction is disposed in the inner circumferential portion of the guide side insertion portion.

According to this configuration, it is possible to guide the movement of the lifting mechanism in the axial direction by the guide member, disposed at the predetermined distance from the shaft member and disposed parallel to the axial direction. Further, the base unit includes the guide side rolling element configured to abut to the guide member from the upper side in the apparatus height direction. In this way, it is possible to suppress the sliding resistance caused by the firsthand contact of the lifting mechanism with the guide member.

In the lifting mechanism described above, it is preferable that the base unit includes a protrusion portion facing the guide member from a lower side in the apparatus height direction in the inner circumferential portion of the guide side insertion portion.

According to this configuration, the base unit includes the guide side rolling element configured to abut to the guide member from the upper side in the apparatus height direction and includes the protrusion portion facing the guide member from the lower side in the apparatus height direction. In this way, it is possible to regulate the pivoting of the lifting mechanism around the pivoting shaft even when the operation lever is pivoted around the pivoting shaft.

What is claimed is:

1. A recording apparatus comprising:

a lifting mechanism lifting and lowering a roll-shaped medium, wherein the lifting mechanism includes a lifting unit which lifts and lowers in an apparatus height direction and on which the roll-shaped medium is placed, a position adjustment unit configured to adjust a position of the lifting unit in the apparatus height direction, and a base unit supporting the lifting unit and the position adjustment unit, the base unit includes an insertion portion through which a shaft member supporting the base unit is inserted, the insertion portion includes an inner circumferential portion facing an outer circumferential portion of the shaft member, a plurality of rolling elements is disposed in the inner circumferential portion of the insertion portion, and the plurality of rolling elements protrudes from the inner circumferential portion of the insertion portion when viewed in an axial direction in which the shaft member extends.

2. The recording apparatus according to claim 1, wherein, when a straight line is defined as a line which is orthogonal to the axial direction and the apparatus height direction, and when the straight line passes through a center of the shaft member, at least three rolling elements of the plurality of rolling elements are disposed in the inner circumferential portion of the insertion portion above the straight line in the apparatus height direction and in the inner circumferential portion of the insertion portion below the straight line in the apparatus height direction.

3. The recording apparatus according to claim 2, wherein the plurality of rolling elements are arranged in parallel substantially in the axial direction.

4. The recording apparatus according to claim 1, further comprising:

a guide member disposed at a predetermined distance from the shaft member and the guide member that supports the lifting mechanism together with the shaft member, wherein the base unit includes a guide side insertion portion through which the guide member is inserted, the guide side insertion portion includes an inner circumferential portion facing an outer circumferential portion of the guide member, and a guide side rolling element configured to abut to the guide member from an upper side in the apparatus height direction is disposed in the inner circumferential portion of the guide side insertion portion.

5. The recording apparatus according to claim 4, wherein the base unit includes a protrusion portion facing the guide member from a lower side in the apparatus height direction in the inner circumferential portion of the guide side insertion portion.

6. A lifting mechanism comprising:

a lifting unit which lifts and lowers in an apparatus height direction and on which a roll-shaped medium is placed;

a position adjustment unit configured to adjust a position of the lifting unit in the apparatus height direction; and a base unit supporting the lifting unit and the position adjustment unit, wherein the base unit includes an insertion portion through which a shaft member supporting the base unit is inserted, the insertion portion includes an inner circumferential portion facing an outer circumferential portion of the shaft member, a plurality of rolling elements is disposed in the inner circumferential portion of the insertion portion, and the plurality of rolling elements protrudes from the inner circumferential portion of the insertion portion when viewed in a axial direction in which the shaft member extends.

7. The lifting mechanism according to claim 6, wherein, when a straight line is defined as a line which is orthogonal to the axial direction and the apparatus height direction, and when the straight line passes through a center of the shaft member, at least three rolling elements of the plurality of rolling elements are disposed in the inner circumferential portion of the insertion portion above the straight line in the apparatus height direction and in the inner circumferential portion of the insertion portion below the straight line in the apparatus height direction.

8. The lifting mechanism according to claim 7, wherein the plurality of rolling elements are arranged in parallel substantially in the axial direction.

9. The lifting mechanism according to claim 6, further comprising:

a guide member disposed at a predetermined distance from the shaft member and the guide member supports the base unit together with the shaft member, wherein the base unit includes a guide side insertion portion through which the guide member is inserted, the guide side insertion portion includes an inner circumferential portion facing an outer circumferential portion of the guide member, and a guide side rolling element configured to abut to the guide member from an upper side in the apparatus height direction is disposed in the inner circumferential portion of the guide side insertion portion.

10. The lifting mechanism according to claim 9, wherein the base unit includes a protrusion portion facing the guide member from a lower side in the apparatus height direction in the inner circumferential portion of the guide side insertion portion.

* * * * *